US010744768B2

(12) United States Patent
Miwa

(10) Patent No.: US 10,744,768 B2
(45) Date of Patent: Aug. 18, 2020

(54) BONDED SUBSTRATE, LIQUID DISCHARGE HEAD, AND LIQUID DISCHARGE APPARATUS

(71) Applicant: Keishi Miwa, Kanagawa (JP)

(72) Inventor: Keishi Miwa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/262,247

(22) Filed: Jan. 30, 2019

(65) Prior Publication Data

US 2019/0275796 A1 Sep. 12, 2019

(30) Foreign Application Priority Data

Mar. 12, 2018 (JP) ..... 2018-043939
Nov. 14, 2018 (JP) ..... 2018-213667

(51) Int. Cl.
*B41J 2/14* (2006.01)
*B41J 2/16* (2006.01)

(52) U.S. Cl.
CPC ..... *B41J 2/14233* (2013.01); *B41J 2/161* (2013.01); *B41J 2/1623* (2013.01); *B41J 2/1629* (2013.01); *B41J 2/1631* (2013.01); *B41J 2/1642* (2013.01); *B41J 2/1643* (2013.01); *B41J 2/1645* (2013.01); *B41J 2/1646* (2013.01)

(58) Field of Classification Search
CPC ..... B41J 2/14233; B41J 2/1623; B41J 2/161; B41J 2/1645; B41J 2/1642; B41J 2/1631; B41J 2/1643; B41J 2/1646; B41J 2/1629
See application file for complete search history.

(56) References Cited

U.S. PATENT DOCUMENTS 10,518,548 B2 * 12/2019 Yamada ..... B41J 2/1404
2015/0171307 A1 6/2015 Masuda et al.
2016/0001556 A1 1/2016 Masuda et al.
2017/0100934 A1 4/2017 Masuda et al.

FOREIGN PATENT DOCUMENTS

JP 2014-172281 9/2014
JP 2018-069654 5/2018

* cited by examiner

*Primary Examiner* — Geoffrey S Mruk

(74) *Attorney, Agent, or Firm* — Oblon, McClelland, Maier & Neustadt, L.L.P.

(57) ABSTRACT

A bonded substrate includes a first substrate, a second substrate bonded to the first substrate with adhesive applied to the second substrate, and a checking structure disposed on the first substrate and facing the second substrate. The checking structure includes a bonding surface portion to be adhered to the second substrate with the adhesive and an insufficiency detection surface to detect insufficient adhesion, a height of the insufficiency detection surface being lower than a height of the bonding surface portion. The adhesive does not contact the insufficiency detection surface when an adhesion state of the bonding surface portion to the second substrate with the adhesive is insufficient, and the adhesive contacts the insufficiency detection surface when the adhesion state of the bonding surface portion to the second substrate with the adhesive is sufficient.

16 Claims, 19 Drawing Sheets

BONDED SUBSTRATE, LIQUID DISCHARGE HEAD, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2018-043939, filed on Mar. 12, 2018, and Japanese Patent Application No. 2018-213667, filed on Nov. 14, 2018, in the Japan Patent Office, the entire disclosure of each of which is hereby incorporated by reference herein.

BACKGROUND

Technical Field

The present disclosure relates to a bonded substrate, a liquid discharge head, and a liquid discharge apparatus.

Related Art

A bonded substrate is known in which a first substrate and a second substrate are bonded together with an adhesive applied to the second substrate side.

For example, an electromechanical transducer substrate is known in which at least a leg of a recess of the second substrate (holding substrate) positioned between the electromechanical transducer elements is bonded to the first substrate with an adhesive so that the second substrate is bonded on the first substrate. The recess of the second substrate (holding substrate) is disposed opposite a plurality of electromechanical transducer elements provided on the first substrate. The electromechanical transducer substrate deforms the electromechanical transducer elements to squeeze pressure chambers of a liquid discharge head of an inkjet recording apparatus.

SUMMARY

In an aspect of this disclosure, a novel bonded substrate is provided in which the bonded substrate includes a first substrate, a second substrate bonded to the first substrate with adhesive applied to the second substrate, and a checking structure disposed on the first substrate and facing the second substrate. The checking structure includes a bonding surface portion to be adhered to the second substrate with the adhesive and an insufficiency detection surface to detect insufficient adhesion, a height of the insufficiency detection surface being lower than a height of the bonding surface portion. The adhesive does not contact the insufficiency detection surface when an adhesion state of the bonding surface portion to the second substrate with the adhesive is insufficient, whereas the adhesive contacts the insufficiency detection surface when the adhesion state of the bonding surface portion to the second substrate with the adhesive is sufficient.

In another aspect of this disclosure, a novel bonded substrate is provided in which the bonded substrate includes a first substrate, a second substrate bonded to the first substrate with adhesive applied to the second substrate, and a checking structure disposed on the first substrate and facing the second substrate. The checking structure includes a bonding surface portion to be adhered to the second substrate and an excess detection surface to detect excessive adhesion, a height of the excess detection surface being lower than a height of the bonding surface portion. The adhesive contacts the excess detection surface when an adhesion state of the bonding surface portion to the second substrate with the adhesive is excessive, whereas the adhesive does not contact the excess detection surface when the adhesion state of the bonding surface portion to the second substrate with the adhesive is not excessive.

In still another aspect of this disclosure, a novel bonded substrate is provided in which the bonded substrate includes a first substrate including a bonding surface portion and a second substrate bonded to the bonding surface portion of the first substrate with adhesive. The first substrate includes a plurality of surface portions in a region enclosed by the bonding surface portion, and the plurality of surface portions includes at least two surface portions each having different heights.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
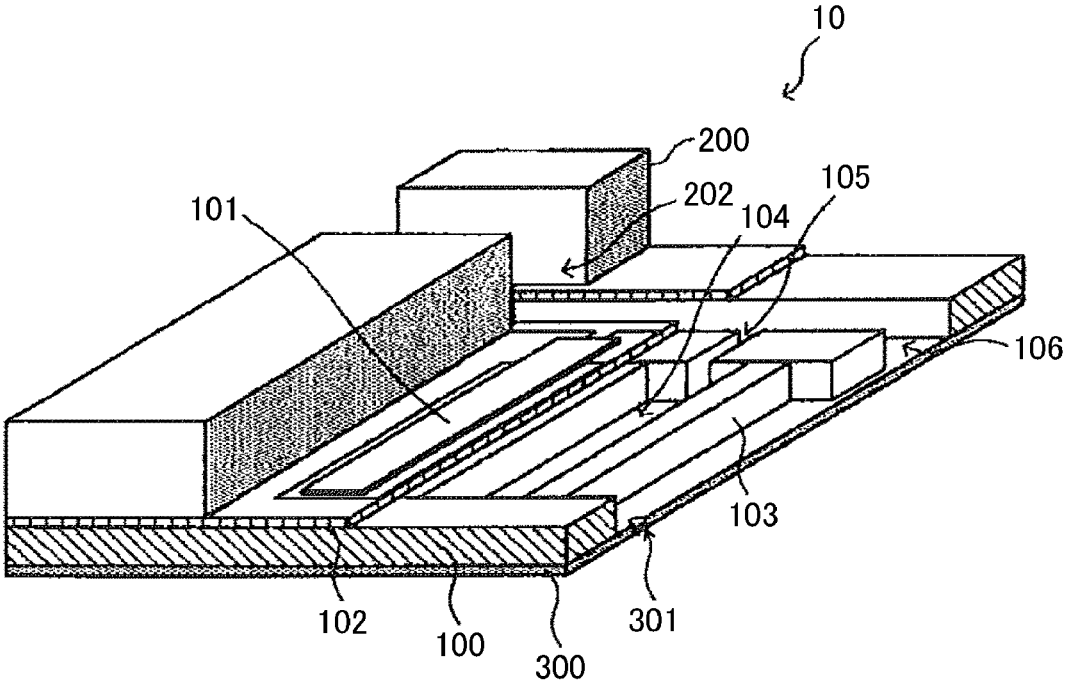
FIG. 1 is a partial cutaway perspective view of an internal configuration of a liquid discharge head according to embodiments of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

In the following, a bonded substrate according to the present embodiment is described below. The bonded substrate is used for manufacturing an electromechanical transducer substrate in a liquid discharge head of an inkjet recording apparatus as one of a liquid discharge apparatus. The liquid discharge apparatus may be used for image formation of the image forming apparatus. The "liquid discharge head" is also simply referred to as a "head".

First, a configuration of the head is described below.

FIG. 1 is a perspective view of a portion of an internal structure of the head according to the present embodiment.

Figure 2:
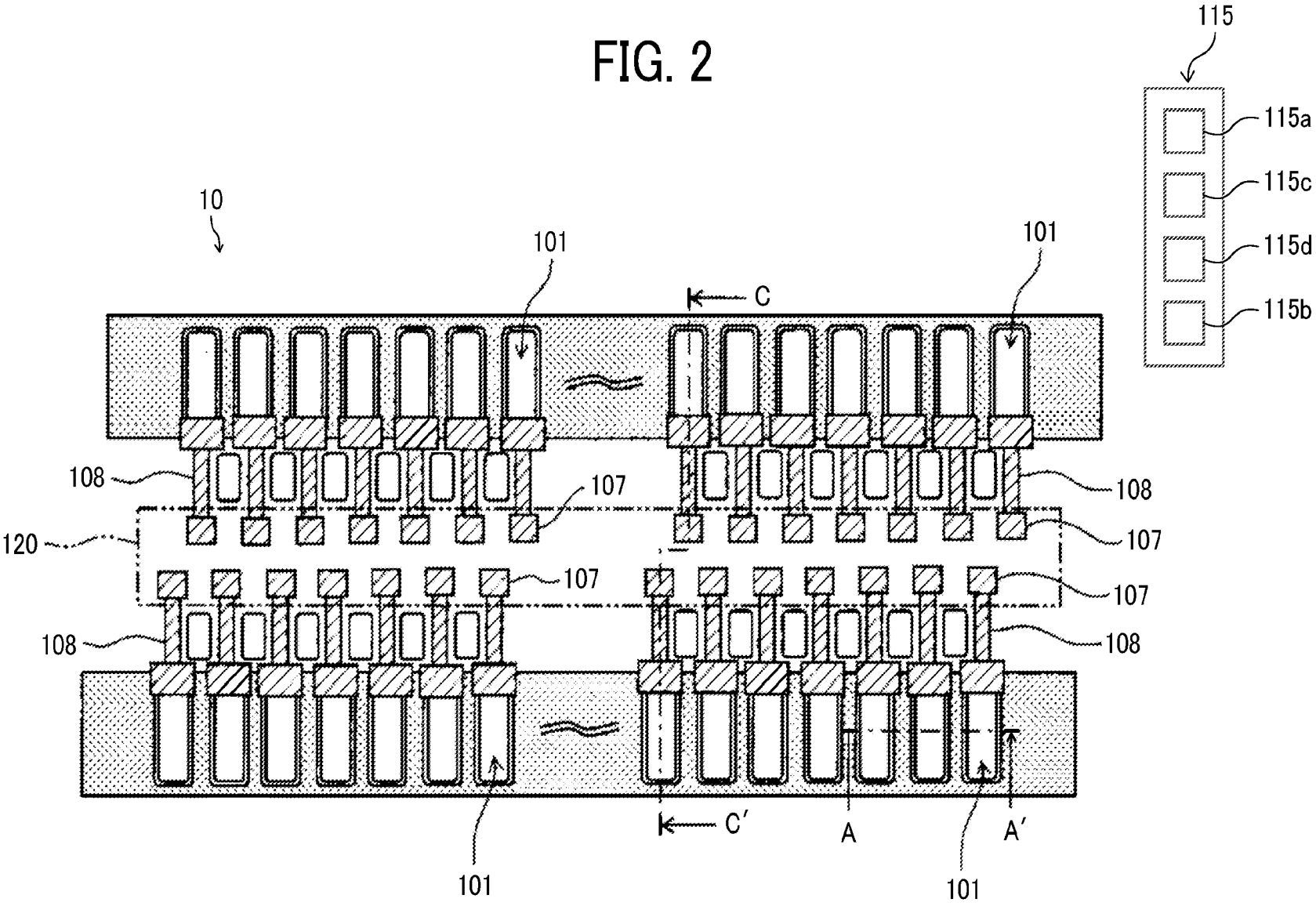
FIG. 2 is a top view of an actuator substrate forming the liquid discharge head.

FIG. 2 is a top view of an actuator substrate forming the head.

Figure 3:
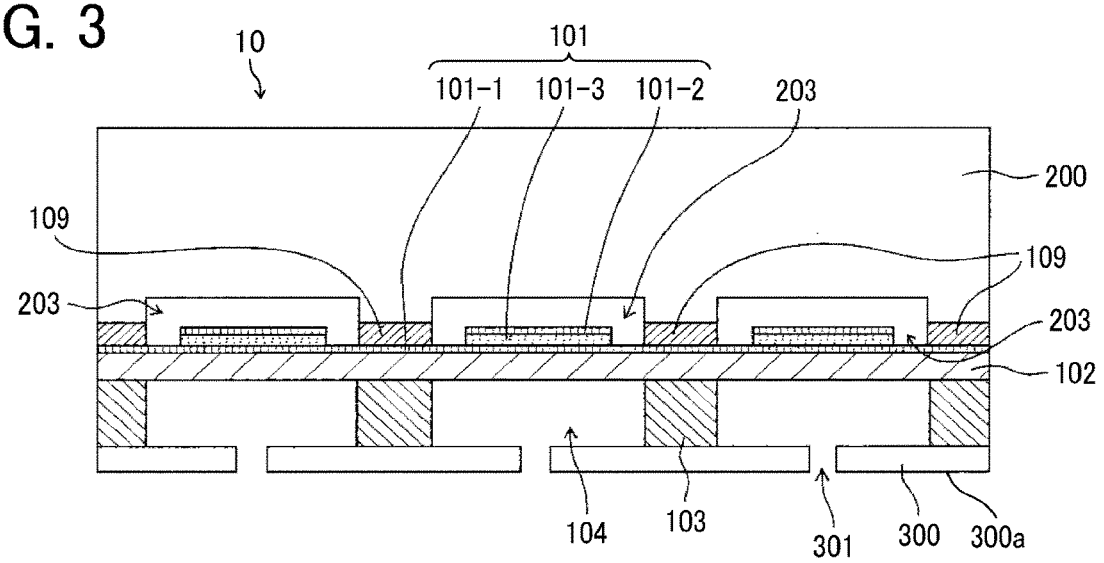
FIG. 3 is a cross-sectional view of the liquid discharge head along line A-A' in FIG. 2.

FIG. 3 is a cross-sectional view of the head along line A-A' in FIG. 2.

Figure 4:
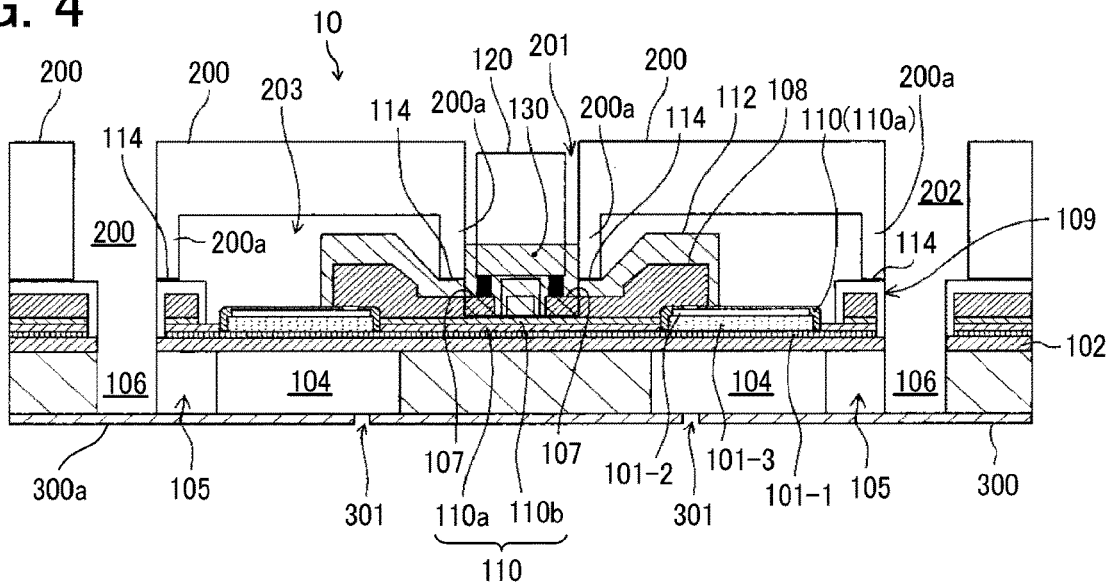
FIG. 4 is a cross-sectional view of the liquid discharge head along line C-C' in FIG. 2.

FIG. 4 is a cross-sectional view of the head along line C-C' in FIG. 2.

In FIG. 2, the holding substrate 200 bonded on the actuator substrate is removed for an explanation.

The head 10 according to the present embodiment mainly includes an actuator substrate 100 formed of a first substrate 100', a holding substrate 200 formed of a second substrate 200', and a nozzle substrate 300. The actuator substrate 100 includes a piezoelectric element 101 as an electromechanical transducer element that generates energy to discharge liquid. The piezoelectric element 101 is formed on an element mounting surface (upper surface in FIG. 1) of a diaphragm 102 as a displacement plate.

Figure 5:
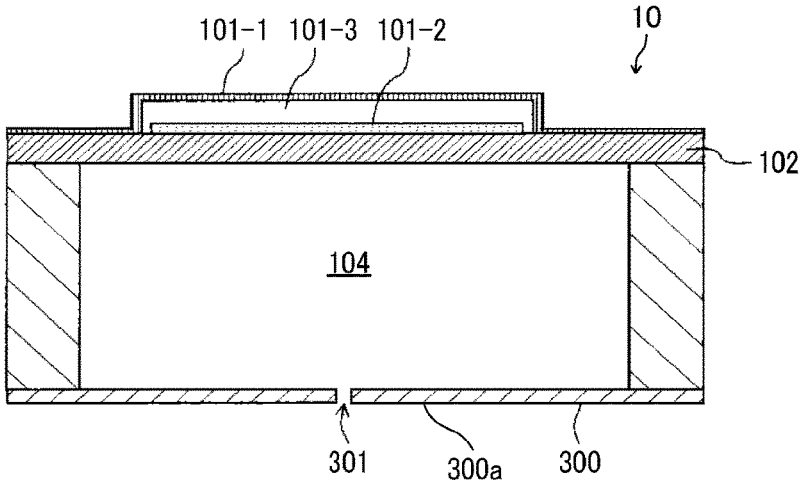
FIG. 5 is a cross-sectional view of a variation of a piezoelectric element in which a lower electrode is an individual electrode layer and an upper electrode is a common electrode layer.

As illustrated in FIG. 3, the piezoelectric element 101 of the present embodiment includes a piezoelectric layer 101-3 sandwiched between a common electrode layer 101-1 as a lower electrode and an individual electrode layer 101-2 as an upper electrode. Alternatively, however, as illustrated in FIG. 5, the piezoelectric element 101 may include the individual electrode layer 101-2 as the lower electrode and the common electrode layer 101-1 as the upper electrode.

Further, the actuator substrate 100 includes a partition wall 103 on a surface (lower surface of the diaphragm 102 in FIG. 3) opposite to the element mounting surface of the diaphragm 102. A space enclosed by the diaphragm 102, the partition wall 103, and the nozzle substrate 300 forms a pressure chamber 104. Further, the actuator substrate 100 forms a fluid restrictor 105 and a common chamber 106.

The holding substrate 200 includes an ink supply port to supply ink from an ink cartridge. The holding substrate 200 adhered to the actuator substrate 100 forms a common channel 202 and a recess 203 forming a space in which the diaphragm 102 of the actuator substrate 100 is bendable and displaceable. The holding substrate 200 may be formed by silicon etching, plastic molding, or the like.

The nozzle substrate 300 includes nozzles 301 formed at a position corresponding to each of the pressure chambers 104. The nozzle substrate 300 may be formed by subjecting a plate made of, for example, SUS to punching, etching, silicon etching, nickel electroforming, resin laser processing, or the like. Thus, the nozzle substrate 300 includes the nozzles 301 to discharge a liquid from the nozzles 301.

The head 10 of the present embodiment applies a drive voltage signal from the driving integrated circuit (IC) 120 to each individual electrode layers 101-2 under the control of a controller with the ink filled in each of the pressure chambers 104. As the drive voltage signal, a pulse voltage of 20 V generated by an oscillation circuit may be used. With an application of the pulse voltage to the piezoelectric layer 101-3, the piezoelectric layer 101-3 contracts in a direction parallel to the diaphragm 102 due to a piezoelectric effect. As a result, the diaphragm 102 bends to protrude toward the pressure chamber 104 side. The pressure in the pressure chamber 104 rapidly rises and ink is discharged from the nozzles 301 communicating with the pressure chamber 104.

After the pulse voltage is applied to the piezoelectric layer 101-3, the piezoelectric layer 101-3 returns from a shrunken position to an original position. Accordingly, the deflected diaphragm 102 also returns from a shrunken position to an original position. Thus, the pressure in the interior of the pressure chamber 104 becomes negative compared to the pressure inside the common chamber 106. Thus, the ink supplied from the ink cartridge via the ink supply port is supplied from the common channel 202 and the common chamber 106 to the pressure chamber 104 via the fluid restrictor 105. The head 10 repeats the processes as described above to enable a continuous discharge of ink droplets so that an image is formed on a recording material disposed opposite the head 10.

Next, a method of manufacturing the head 10 according to the present embodiment is described.

FIGS. 6A to 6D, 7A to 7C, and 8A to 8C are cross-sectional views of the head 10 perpendicular to an arrangement direction of the nozzles 301 illustrating the manufacturing process of the head 10 according to the present embodiment.

As a base material of the actuator substrate 100, a silicon single crystal substrate is preferably used. The silicon single crystal substrate usually preferably has a thickness of 100 to 600 μm. The silicon single crystal substrate has three types of plane orientations of (100), (110), and (111). However, the plane orientations of (100) and (111) are widely used in a semiconductor industry in general. The single crystal substrate mainly having a plane orientation of (100) is used in the present embodiment. Further, the silicon single crystal substrate is processed by etching in a step of forming the pressure chamber 104 in the actuator substrate 100.

Anisotropic etching is typically used as a method of etching the silicon single crystal substrate to form the pressure chamber 104. The anisotropic etching utilizes a property in which an etching rate is different according to plane orientations of crystal structure of the silicon single crystal substrate. For example, in anisotropic etching that immerses the silicon single crystal substrate in an alkaline solution such as KOH, an etching rate of the plane orientation of (111) is about 1/400 of an etching rate of the plane orientation of (100).

Accordingly, a structure having an inclination of about 54° can be produced in the plane orientation of (100). On the other hand, a deep groove can be formed in the plane orientation (110), thus an array density to be increased while rigidity is maintained. Thus, a single crystal substrate having a plane orientation of (110) may also be used for the actuator substrate 100. However, $SiO_2$ as a mask material is also etched during an etching process when the single crystal substrate having a plane orientation of (110) is used.

Figure 6A:
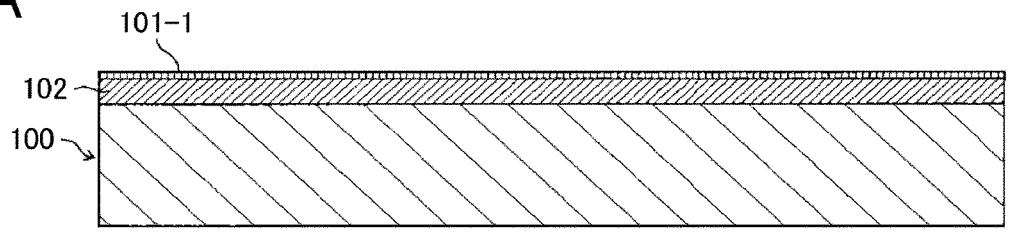
FIGS. 6A to 6D are cross-sectional views of the liquid discharge head perpendicular to a nozzle array direction illustrating a front stage of a manufacturing process of the liquid discharge head.

First, as illustrated in FIG. 6A, a film to become the diaphragm 102 is formed on the silicon single crystal substrate (actuator substrate 100). The diaphragm 102 repeatedly deforms under a force generated by the piezoelectric element 101. Thus, the diaphragm 102 preferably has sufficient strength to withstand a repeated deformation. Examples of material include Si, $SiO_2$, and $Si_3N_4$ prepared by a chemical vapor deposition (CVD) method. Further, the diaphragm 102 is preferably made of material selected from a material having a linear expansion coefficient close to a linear expansion coefficient of the individual electrode layer 101-2 and the piezoelectric layer 101-3 to be bonded to the diaphragm 102.

A material of lead zirconate titanate (PZT) is used as the piezoelectric layer 101-3 in the present embodiment. Thus, a material having a linear expansion coefficient of $5\times10^{-6}$ to $10\times10^{-6}$ (1/K) close to a linear expansion coefficient $8\times10^{-6}$ (1/K) of the PZT is preferably used for the diaphragm 102. Furthermore, a material having a linear expansion coefficient of $7\times10^{-6}$ to $9\times10^{-6}$ (1/K) is more preferable.

Specific examples of the materials of the diaphragm 102 include aluminum oxide, zirconium oxide, iridium oxide, ruthenium oxide, tantalum oxide, hafnium oxide, osmium oxide, rhenium oxide, rhodium oxide, palladium oxide, and compounds of the foregoing materials. Using such materials, the diaphragm 102 can be produced by a spin coater using sputtering or a sol-gel method.

The film thickness is preferably in a range from 0.1 μm to 10 μm and is more preferably in a range from 0.5 μm to 3 μm. If the film thickness of the diaphragm 102 is smaller than the range from 0.1 μm to 10 μm, it is difficult to process the pressure chamber 104. If the film thickness of the diaphragm 102 is greater than the range from 0.1 μm to 10 μm, the diaphragm 102 may be less deformed and displaced, thus hampering stable discharge of ink droplets.

Next, a common electrode layer 101-1 is formed on the diaphragm 102 formed in the above-described manner. The common electrode layer 101-1 preferably includes a metal film single layer or a multilayer structure of a metal film and an oxide film. In any case, an adhesion layer is preferably inserted between the diaphragm 102 and the metal film to suppress peeling or the like.

As the adhesion layer, titanium (Ti) is deposited by sputtering, and a titanium film is thermally oxidized in an $O_2$ atmosphere at temperature from 650° C. to 800° C. for one to thirty minutes using a rapid thermal annealing (RTA) apparatus to transform the titanium film to a titanium oxide film. Reactive sputtering may be used to prepare the titanium oxide film. However, it is more preferable to thermal oxidize the titanium film at high temperature. The fabrication of the titanium oxide film by the reactive sputtering needs to heat the silicon substrate at a high temperature.

Thus, a special sputtering chamber to heat the silicon substrate is required. Further, oxidation by the RTA apparatus provides better crystallinity of the titanium oxide film than oxidation by a general furnace. A titanium film that is easily oxidized may form plural crystal structures at low temperature under the oxidation by a general furnace. Thus, the plural crystal structures of the titanium film have to be destroyed once. Therefore, the oxidation by RTA apparatus with a fast temperature rise can form good crystals.

As a material other than titanium (Ti), materials such as tantalum (Ta), iridium (Ir), ruthenium (Ru), for example, are also preferable. The film thickness is preferably from 10 nm to 50 nm and is more preferably from 15 nm to 30 nm. If the film thickness is below the above-described range (from 10 nm to 50 nm), an adhesion may be reduced. If the film thickness is over the above-described range (from 10 nm to 50 nm), quality of crystal of an electrode film to be formed on the adhesion layer may be deteriorated.

As a metal film for preparing the common electrode layer 101-1, platinum having high heat resistance and low reactivity has been used. Platinum may not have sufficient barrier properties against lead in some cases. Thus, platinum group elements such as iridium and platinum-rhodium and alloy films of platinum group elements may be used as the metal material for the metal film for forming the common electrode layer 101-1. Adhesion of platinum with a base (in particular, $SiO_2$) may be poor.

Therefore, the adhesion layer as described-above is preferably laminated in advance on the base. As a method of manufacturing the metal film, vacuum film formation such as sputtering, or a vacuum vapor deposition is generally used. The film thickness of the adhesion layer is preferably from 80 to 200 nm and is more preferably from 100 to 150 nm. If the film thickness of the adhesion layer is thinner than 80 to 200 nm, the metal film may be difficult to supply a sufficient current as a common electrode. Thus, a problem occurs during discharging an ink.

Further, if the film thickness of the adhesion layer is thicker than 80 to 200 nm, cost for manufacturing the common electrode layer 101-1 increases when an expensive material of the platinum group element is used. If platinum is used as material, a surface roughness increases when the film thickness is increased. Increase in the surface roughness of the common electrode layer 101-1 influences the surface roughness and crystal orientation of the oxide electrode film or PZT. Thus, the diaphragm 102 may not be sufficiently displaced for discharging ink.

$SrRuO_3$ is preferably used as material of a metal oxide film for preparing the common electrode layer 101-1. Instead of $SrRuO_3$, material as described as $Sr_xA_{(1-x)}Ru_yB_{(1-y)}$ such as (A=Ba, Ca, B=Co, Ni, x, y=0 to 0.5) may be used for the metal oxide film for forming the common electrode layer 101-1. Sputtering may be adopted to form the metal oxide film. The film quality of a $SrRuO_3$ thin film changes depending on the sputtering conditions. Particularly, it is preferable to heating the substrate at a film formation temperature of 500° C. or higher to form the metal oxide film in order to orient the $SrRuO_3$ film in (111) plane along with Pt (111) plane used for the metal film with emphasis on crystal orientation.

A lattice constant of Pt is close to a lattice constant of $SrRuO_3$, and thus 2θ position of $SrRuO_3$ (111) and 2θ position of Pt (111) overlap in usual 2θ/θ measurement. Thus, crystallinity of the $SrRuO_3$ thin film formed on Pt (111) is difficult to distinguish. A diffraction intensity of Pt cannot be seen at a position of 2θ at about 32° in a Psi direction inclined by 35° because a diffraction lines cancel each other according to the extinction rule. Thus, it is possible to ascertain whether $SrRuO_3$ is preferentially oriented to (111) by determining a peak intensity of 2θ at about 32° by tilting the Psi direction by about 35°.

When Psi direction is tilted while 2θ is fixed to 2θ=32°, almost no diffraction intensity of $SrRuO_3$ (110) is observed at Psi=0°, and the diffraction intensity of $SrRuO_3$ (110) is observed at the vicinity of Psi=35°. Thus, it is confirmed that $SrRuO_3$ is oriented in (111) plane with respect to the metal film prepared under the film forming conditions of the present embodiment. The diffraction intensity of $SrRuO_3$ (110) is observed at Psi=0° for the $SrRuO_3$ film thus manufactured.

An amount of degradation in a displacement amount of the piezoelectric element 101 after continuously driving and displacing the piezoelectric element 101 for a predetermined time from an initial displacement amount of the piezoelectric element 101 is estimated. The orientation of PZT is very influential, and (110) plane is insufficient in suppressing degradation of displacement of PZT.

Further, when the surface roughness of the $SrRuO_3$ film is observed, a surface roughness is extremely small that becomes 2 nm or less at room temperature of 300° C. since film forming temperature affects the surface roughness. When the surface roughness of the $SrRuO_3$ film is 2 nm or less, although the surface of the $SrRuO_3$ film is very flat, the crystallinity of the $SrRuO_3$ film is not sufficient.

Thus, sufficient characteristics in the initial displacement amount and displace amount after the continuous driving of the piezoelectric element 101 formed on the $SrRuO_3$ film may not be obtained. The surface roughness of the $SrRuO_3$ film is preferably 4 nm to 15 nm and is more preferably 6 nm to 10 nm. If the surface roughness of the $SrRuO_3$ film is greater than 15 nm, the dielectric strength voltage of a subsequently formed PZT film is very low, and leakage may occur.

Therefore, to obtain good crystallinity and surface roughness, it is preferable to perform film formation at a film forming temperature in a range from 500° C. to 700° C. and is more preferably from 520° C. to 600° C. The surface roughness is based on a surface roughness (average roughness) measured by an atomic force microscope (AFM) as an index.

A composition ratio Sr/Ru of Sr and Ru after forming the $SrRuO_3$ film is preferably 0.82 or more and 1.22 or less. When the composition ratio Sr/Ru is out of the above-described range (0.82 or more and 1.22 or less), a specific resistance increases, and sufficient conductivity may not be obtained as the common electrode layer 101-1.

The film thickness of the $SrRuO_3$ film is preferably from 40 nm to 150 nm and is more preferably from 50 nm to 80 nm. If the film thickness of the $SrRuO_3$ film is thinner than the above-described range (from 40 nm to 150 nm), a sufficient characteristic in the initial displace amount and displace amount after the continuous driving may not be obtained. Further, the $SrRuO_3$ film may not function as a stop etching layer for suppressing over-etching of PZT.

Conversely, if the film thickness of the $SrRuO_3$ film is thicker than the above-described range (from 40 nm to 150 nm), a dielectric breakdown voltage of a PZT film formed on the $SrRuO_3$ film decreases, and the PZT film easily leaks. Further, the specific resistance of the $SrRuO_3$ film is preferably $5\times10^{-3}$ Ω·cm or less and is more preferably $1\times10^{-3}$ Ω·cm or less.

If the specific resistance of the $SrRuO_3$ film is larger than the above-described range ($5\times10^{-3}$ Ω·cm or less), a contact resistance increases at an interface between the $SrRuO_3$ film as the common electrode layer 101-1 and an electrode in contact with the common electrode layer 101-1. Thus, the $SrRuO_3$ film cannot supply a sufficient current as the common electrode layer 101-1, and a trouble occurs during discharging the ink.

Figure 6B:
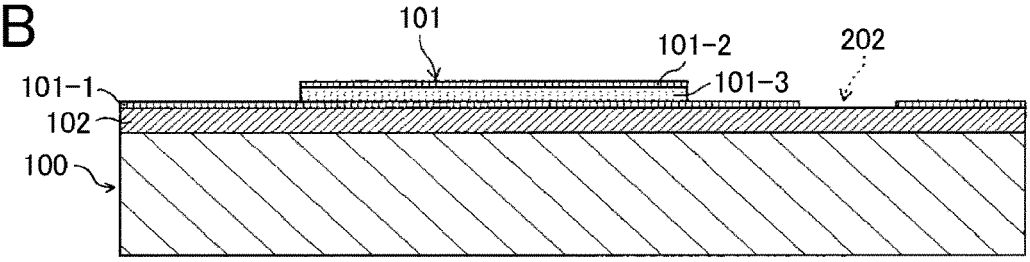

Next, as illustrated in FIG. 6B, the piezoelectric layer 101-3 is formed on the common electrode layer 101-1. PZT is used as the material of the piezoelectric layer 101-3 in the present embodiment. The PZT is a solid solution of lead zirconate ($PbZrO_3$) and titanium acid ($PbTiO_3$) and has different characteristics according to a ratio of the lead zirconate ($PbZrO_3$) and the titanium acid ($PbTiO_3$) in the solution.

When the ratio of $PbZrO_3$ and $PbTiO_3$ is 53:47, the PZT has a generally excellent piezoelectric property. The composition is represented by a chemical formula of $Pb(Zr_{0.53}, Ti_{0.47})O_3$, generally, PZT(53/47). An example of a composite oxide other than the PZT is barium titanate. In such a case, barium alkoxide and titanium alkoxide compounds are used as a starting material and are dissolved in a common solvent, to prepare a barium titanate precursor solution.

The above-described materials are represented by a general formula $ABO_3$ and corresponds to composite oxides including A=Pb, Ba, Sr, and B=Ti, Zr, Sn, Ni, Zn, Mg, and Nb as main components. A specific description of the composite oxide is, for example, $(Pb_{1-x}, Ba)(Zr, Ti)O_3$, $(Pb_{1-x}, Sr)(Zr, Ti)O_3$. The specific description of $(Pb_{1-x}, Ba)(Zr, Ti)O_3$, $(Pb_{1-x}, Sr)(Zr, Ti)O_3$ means that Pb of A site is partially replaced with Ba or Sr. The substitution of Pb to Ba or Sr is enabled by a bivalent element, and the substitution has an effect to reduce deterioration of characteristic occurred by an evaporation of lead during heat treatment.

The piezoelectric layer 101-3 can be prepared by a spin coater using sputtering or a Sol-gel method. When the sputtering or the Sol-gel method is used to prepare the piezoelectric layer 101-3, a desired pattern is obtained by photolithographic etching because patterning is necessary. When PZT is prepared by the Sol-gel method, lead acetate, zirconium alkoxide, titanium alkoxide compound is used as a starting material and the starting material is dissolved in methoxyethanol as a common solvent to obtain a homogeneous solution, and thus a PZT precursor solution can be prepared. The metal alkoxide compound is readily hydrolyzed by moisture in the atmosphere, and thus a stabilizer such as acetylacetone, acetic acid, diethanolamine or the like may be added as a stabilizer to the precursor solution in an appropriate amount.

To form the PZT film on a whole surface of a base substrate, a coating film is formed on the base substrate by a solution coating method such as spin coating, and the coating film is subjected to each heat treatment such as solvent drying, thermal decomposition, and crystallization. Transformation from the coating to a crystalline film causes volume contraction. Thus, it is preferable to adjust the precursor concentration so that a film thickness of 100 nm or less can be obtained in a single step to obtain a crack-free film.

The layer thickness of the piezoelectric layer 101-3 is preferably from 0.5 to 5 μm and is more preferably from 1 μm to 2 μm. If the layer thickness of the piezoelectric layer 101-3 is smaller than the above-described range (from 0.5 to 5 μm), the piezoelectric layer 101-3 may not sufficiently displaced. If the layer thickness of the piezoelectric layer 101-3 is larger than the above-described range (from 0.5 to 5 μm), many layers has to be laminated to prepare the piezoelectric layer 101-3, and thus the number of steps for preparing the piezoelectric layer 101-3 increases and the process time increases.

A relative permittivity of the piezoelectric layer 101-3 is preferably 600 or more and 2000 or less and is more preferably 1200 or more and 1600 or less. If the relative permittivity of the piezoelectric layer 101-3 is smaller than the above-described range (600 or more and 2000 or less), the piezoelectric layer 101-3 may not exhibit sufficient displacement characteristics. If the relative permittivity of the piezoelectric layer 101-3 is larger than the above-described range (600 or more and 2000 or less), the polarization treatment may not be sufficiently performed on the piezoelectric layer 101-3. Thus, the piezoelectric layer 101-3 may be difficult to obtain sufficient displacement characteristics due to deterioration of displacement after continuous driving of the piezoelectric element 101.

As illustrated in FIG. 6B, after the piezoelectric layer 101-3 is formed on the common electrode layer 101-1, the individual electrode layer 101-2 is formed on the piezoelectric layer 101-3. Similarly to the common electrode layer 101-1, the individual electrode layer 101-2 also preferably includes a metal film single layer or a multilayer including a metal film and an oxide film. As the oxide film, an oxide film described for the common electrode layer 101-1 can be used. The film thickness of the $SrRuO_3$ film as the oxide film is preferably from 20 nm to 80 nm and is more preferably from 40 nm to 60 nm. As the metal film, the metal film described for the common electrode layer 101-1 can be used. The film thickness of the metal film is preferably from 30 to 200 nm and is more preferably from 50 to 120 nm.

Figure 6C:
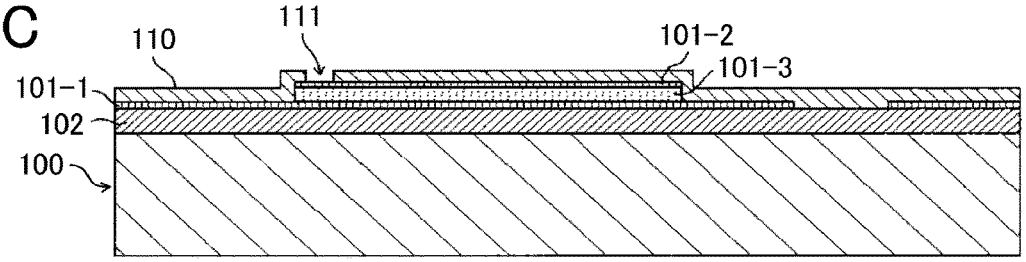

Next, as illustrated in FIG. 6C, an interlayer insulating film 110 is formed on the common electrode layer 101-1 to insulate the common electrode layer 101-1 and the piezoelectric element 101 from a lead wire 108 to be formed on the interlayer insulating film 110. Further, the interlayer insulating film 110 has to be made of a dense inorganic material since the interlayer insulating film 110 functions to prevent damage to the piezoelectric element 101 occurred during film formation and etching processes. Further, a material of the interlayer insulating film 110 has to be selected from a material that is difficult to transmit moisture in the atmosphere, and thus the dense inorganic material is used as the material of the interlayer insulating film 110.

An organic material is not suitable as material of the interlayer insulating film 110 because the organic material is necessary to increase the film thickness to obtain sufficient protection performance. The organic material is not suitable because the deformation of the diaphragm 102 may be hampered when the interlayer insulating film 110 is made thick, and thus an inkjet head having low discharge performance may be formed by using the organic material.

As the interlayer insulating film 110, it is preferable to use an oxide, a nitride, a carbonized film, for example, to obtain a high protective performance with a thin film. Thus, it is preferable to select a material having high adhesiveness to the electrode material, the piezoelectric material, and the diaphragm material that is to be the base of the interlayer insulating film 110. Further, a film formation method that does not damage the piezoelectric element 101 has to be adopted. That is, it is not preferable to use a plasma CVD method in which a reactive gas is converted into a plasma and deposited on a substrate or sputtering in which a plasma is deposited by colliding with a target material to form a film.

As an example of a preferable film formation method, there are a deposition method, an atomic layer deposition (ALD) method, and the like. The ALD method is preferable among the film forming methods because the ALD method has a wide choice of materials that can be used. Preferred materials include oxide film used for ceramic material such as $Al_2O_3$, $ZrO_2$, $Y_2O_3$, $Ta_2O_3$, and $TiO_2$, for example. Using the ALD method can prepare a thin film having a very high film density and can suppress the damage to the piezoelectric element 101 occurred during the film forming process.

The interlayer insulating film 110 has to be sufficiently thick to ensure a protection performance of the piezoelectric element 101. At the same time, the interlayer insulating film 110 has to be made as thin as possible so as not to hinder a deformation of the diaphragm 102. Therefore, the preferable range of the film thickness of the interlayer insulating film 110 is from 20 nm to 100 nm. When the thickness of the interlayer insulating film 110 is greater than 100 nm, the amount of deformation of the diaphragm 102 decreases, so that the inkjet head has low discharge efficiency. Conversely, when the thickness of the interlayer insulating film 110 is less than 20 nm, the interlayer insulating film 110 insufficiently functions as a protective layer of the piezoelectric element 101, so that the performance of the piezoelectric element 101 decreases.

Alternatively, the interlayer insulating film 110 may have a two-layer structure. If the interlayer insulating film 110 has a two-layer structure, as illustrated in FIG. 4, a first insulating protective film 110*a* and a second insulating protective film 110*b*. The second insulating protective film 110*b* is made thick, and a portion of the second insulating protective film 110*b* disposed to overlap with the piezoelectric element 101 may be removed so that only the first insulating protective film 110*a* is remained so that the diaphragm 102 can easily deform.

Any oxide, nitride, carbide or a complex compound of oxide, nitride, and carbide may be used for the second insulating protective film 110*b*. $SiO_2$ generally used in semiconductor devices may be used for the second insulating protective film 110*b*. Any method may be used for forming the interlayer insulating film 110. Examples of the film formation method includes the CVD may be any suitable method. For example, the CVD method or sputtering method may be used for film formation.

The film thickness of the interlayer insulating film 110 is required to be such a thickness that dielectric breakdown is not caused by the voltage applied between the common electrode layer 101-1 and the individual electrode layer 101-2. That is, it is necessary to set the strength of the electric field applied to the insulating protective film to a range not causing dielectric breakdown. Further, in consideration of the surface property of the underlayer of the interlayer insulating film 110 and pinholes, the film thickness of the interlayer insulating film 110 is preferably 200 nm or more, more preferably 500 nm or more.

Figure 6D:
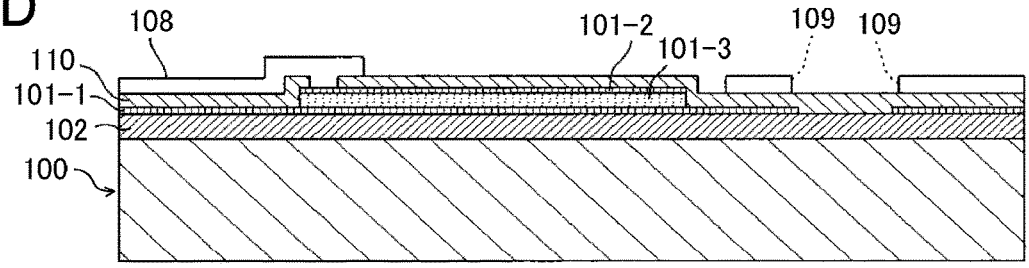

After forming the interlayer insulating film 110, a connection hole 111 for connecting the individual electrode layer 101-2 and the lead wire 108 is formed by a photolithographic etching. Further, a connection hole is similarly formed in the interlayer insulating film 110 when the common electrode layer 101-1 is connected to another lead wire 108. Then, as illustrated in FIG. 6D, lead wire 108 is formed on the interlayer insulating film 110.

As a material of the lead wire 108, a metal electrode material composed of any one of an Ag alloy, Cu, Al, Au, Pt, and Ir is preferable. As a method for preparing the lead wire 108, sputtering or a spin coating is used, and then a desired pattern is obtained by photolithography or the like. The film thickness of the lead wire 108 is preferably from 0.1 to 20 μm and is more preferably from 0.2 to 10 m. If the film thickness of the lead wire 108 is smaller than the above-described range (from 0.1 to 20 μm), resistance increases and may prevent a sufficient current from flowing to the individual electrode layer 101-2, and thus causing unstable discharge of the head 10. If the film thickness of the lead wire 108 is larger than the above-described range (from 0.1 to 20 μm), time for processing (preparing) the lead wire 108 increases.

The contact resistance of the lead wire 108 with the individual electrode layer 101-2 in the connection hole 111 is preferably 1Ω or less and is more preferably 0.5Ω or less. The contact resistance of the lead wire 108 with the common electrode layer 101-1 in a connection hole is preferably 10Ω or less and is more preferably 5Ω or less. If the contact resistance of the lead wire 108 with the individual electrode layer 101-2 is larger than the above described range (1Ω or less), the lead wire 108 cannot supply a sufficient current to the piezoelectric element 101, and thus a problem occurs when discharge ink.

Further, as described below, the lead wire 108 is also formed in a bonding region of the holding substrate 200. Thus, in the present embodiment, as illustrated in FIG. 4, a layer structure identical to a layer structure of the bonding region of the lead wire 108 side is formed in the bonding region 109 where the holding substrate 200 is bonded to form a uniform height of the bonding region of the holding substrate 200. The bonding region 109 is disposed on a side (on the common channel 202 side) opposite to the lead wire 108 with the piezoelectric element 101 interposed between the lead wire 108 and the bonding region 109. Thus, the lead wire 108 can be reliably bonded to the holding substrate 200.

Figure 7A:
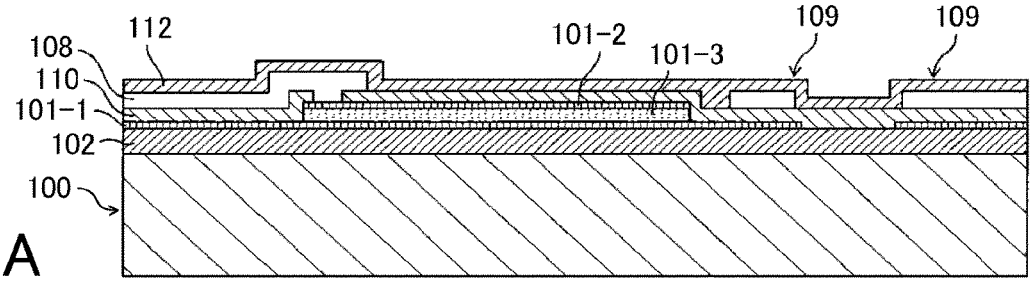
FIGS. 7A to 7C are cross-sectional views of the liquid discharge head perpendicular to the nozzle array direction illustrating a middle stage of the manufacturing process of the liquid discharge head.

Next, as illustrated in FIG. 7A, a passivation film 112 functioning as a protection layer of the lead wire 108 is formed on the lead wire 108. The passivation film 112 enables a use of inexpensive Al or an alloy material containing Al as a main component as the material of the lead wire 108. Thus, the head 10 of the present embodiment can be manufactured at low cost and can reliably discharge the liquid. As the material of the passivation film 112, any inorganic material or organic material can be used. However, a material having low moisture permeability has to be used as the material of the passivation film 112.

Examples of the inorganic material include oxides, nitrides, carbides, and the like, and examples of the organic material include polyimide, acrylic resin, urethane resin, and the like. However, the passivation film 112 made of the organic material has to be made thick, and thus is not suitable for patterning as described below. Thus, the inorganic material is preferably used for the passivation film 112 because the passivation film 112 made of inorganic material can protect the lead wire 108 with a thin film. Particularly, it is preferable to form the passivation film 112 made of $Si_3N_4$ on the lead wire 108 made of Al that is a technology widely used in semiconductor devices.

The film thickness of the passivation film 112 is preferably 200 nm or more and is more preferably 500 nm or more. When the film thickness of the passivation film 112 is small, the passivation film 112 cannot exhibit sufficient passivation function. Thus, disconnection due to corrosion of the lead wire 108 occurs, and the reliability of the head 10 is lowered.

Figure 7B:
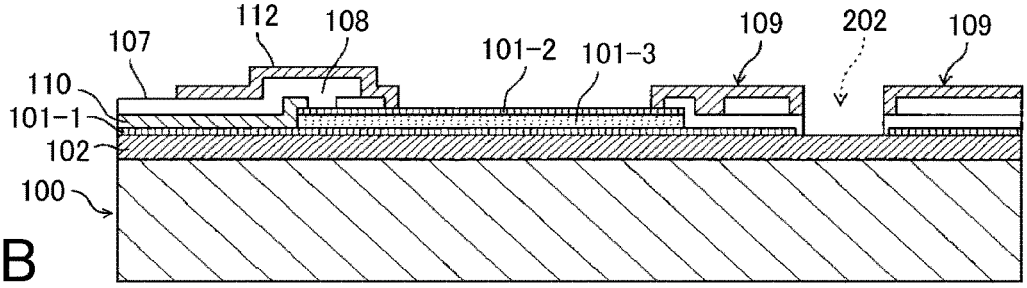

As illustrated in FIG. 7B. a portion of the passivation film 112 disposed on the piezoelectric element 101 and a portion overlapping a vicinity of the piezoelectric element 101 are preferably removed so that the passivation film 112 does not disturb deformation of the diaphragm 102. Thus, an inkjet head (head 10) of the present embodiment can efficiently and reliably discharge the liquid.

Figure 7C:
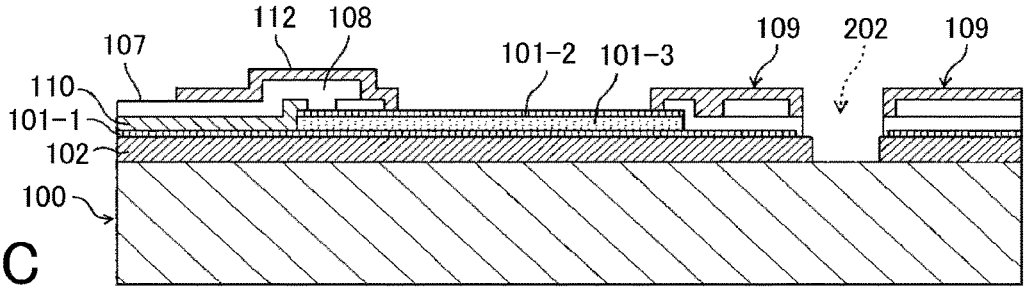

More specifically, as illustrated in FIG. 7B, a photolithography or a dry etching is used for removing an end portion of the lead wire 108 serving as an individual electrode pad 107 connected to the driving IC 120, a part of top surface of the piezoelectric element 101, and the passivation film 112 and the interlayer insulating film 110 at a part of the common channel 202. Then, as illustrated in FIG. 7C, a portion of the diaphragm 102 communicating with the common channel 202 and the common chamber 106 is removed by the photolithographic etching.

Individual electrode pads 107 made of bump electrodes for connecting the driving ICs 120 are formed at the end portions of the lead wire 108. Examples of methods of forming the individual electrode pad 107 include electrolytic plating, electroless plating, stud bumping, and the like. Examples of a material of the individual electrode pad 107 include Au, Ag, Cu, Ni, solder, and the like.

As a method of connecting the driving IC 120 to the individual electrode pad 107, one of following method is selectively used, such as an Anisotropic Conductive Film (ACF) bonding using Flexible Printed Circuits (FPC), solder bonding, wire bonding, and flip chip bonding that directly bonds an output terminal of the driving IC 120 to the individual electrode pad 107, for example.

However, the wire bonding and the flip chip bonding are advantageous in terms of cost compared with the ACF bonding because a parts cost of FPC used in the ACF bonding is expensive. Further, the wire bonding is slower in tact compared with the flip chip bonding, and thus productivity of the wire bonding is poor, and the wire bonding is also disadvantageous for narrowing pitch. Therefore, in the present embodiment, the driving IC 120 is connected to the individual electrode pad 107 by flip chip bonding, and the driving IC 120 is mounted on the actuator substrate 100 by flip chip mounting.

Figure 8A:
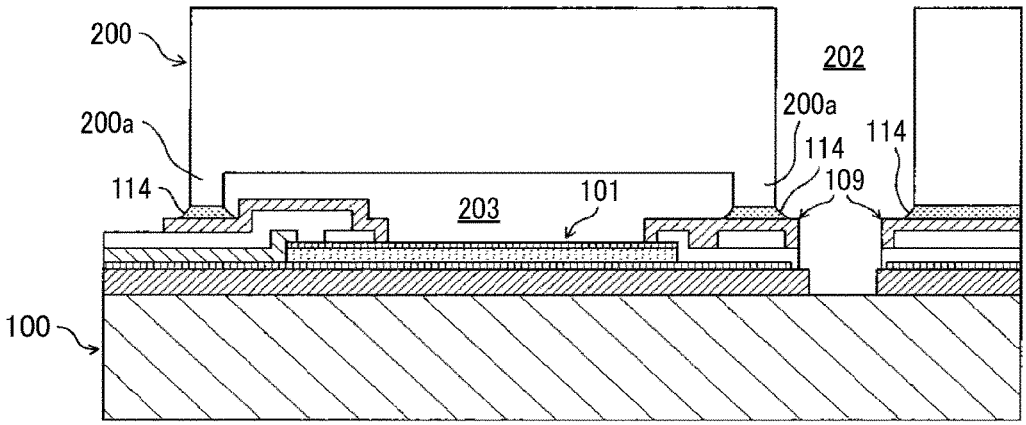
FIGS. 8A to 8C are cross-sectional views of the liquid discharge head perpendicular to the nozzle array direction illustrating a latter stage of a manufacturing process of the liquid discharge head.

Next, as illustrated in FIG. 8A, a leg portion 200*a* of the holding substrate 200, in which the recess 203 is formed at a position corresponding to a diaphragm displacement region 113, and the leg portion 200*a* of the holding substrate 200 is bonded to the bonding region 109 on the actuator substrate 100 with an adhesive 114. The actuator substrate 100 may not ensure a sufficient rigidity if the actuator substrate 100 has a thickness of about 20 to 100 μm for forming the pressure chamber 104, for example.

Thus, the holding substrate 200 is adhered to the actuator substrate 100 to ensure rigidity. Therefore, it is preferable that the holding substrate 200 is not made of a low-rigidity material such as resin but is made of a highly rigid material such as silicon. A material having a thermal expansion coefficient close to a thermal expansion coefficient of the actuator substrate 100 is selected to prevent warping of the actuator substrate 100. Therefore, it is preferable to use a ceramic material such as glass, silicon, $SiO_2$, $ZrO_2$, $Al_2O_3$, and the like.

Figure 9:
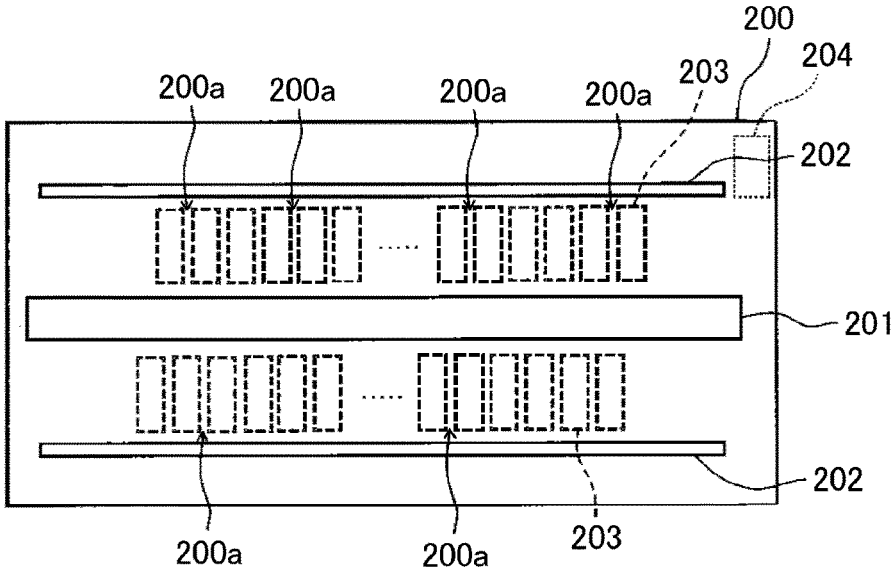
FIG. 9 is a top view of the holding substrate bonded to the actuator substrate.
Figure 10:
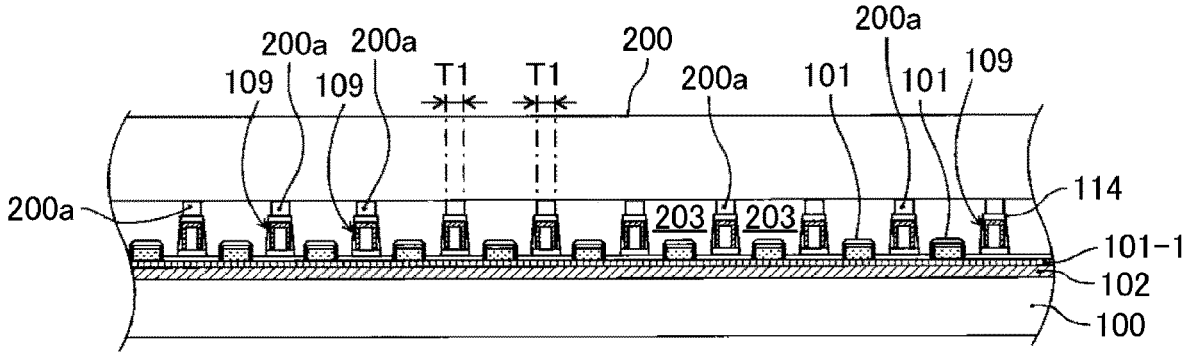
FIG. 10 is a cross-sectional view of a portion of the liquid discharge head along a nozzle array direction (arrangement direction of the piezoelectric elements)

The recess 203 is formed at a position corresponding to the diaphragm displacement region 113 facing the piezoelectric element 101 of the holding substrate 200. This recess 203 secures a space for deformation of the piezoelectric element 101. As illustrated in FIGS. 9 and 10, the recesses 203 of the holding substrate 200 are partitioned so that the recesses 203 correspond to the piezoelectric elements 101, respectively.

Further, the actuator substrate 100 having thin thickness can ensure sufficient rigidity. Thus, mutual interference occurred between adjacent pressure chambers 104 can be reduced during driving each piezoelectric element 101. Further, as illustrated in FIGS. 9 and 10, the recesses 203 of the holding substrate 200 is partitioned for each piezoelectric element 101. Thus, a high processing accuracy is required for increasing a density of the piezoelectric element 101. For example, to obtain the head 10 capable of recording an image of 300 dpi, a width T1 of the partition wall that partitions the recess 203 of the holding substrate 200 is preferably from 5 to 20 μm.

Figure 8B:
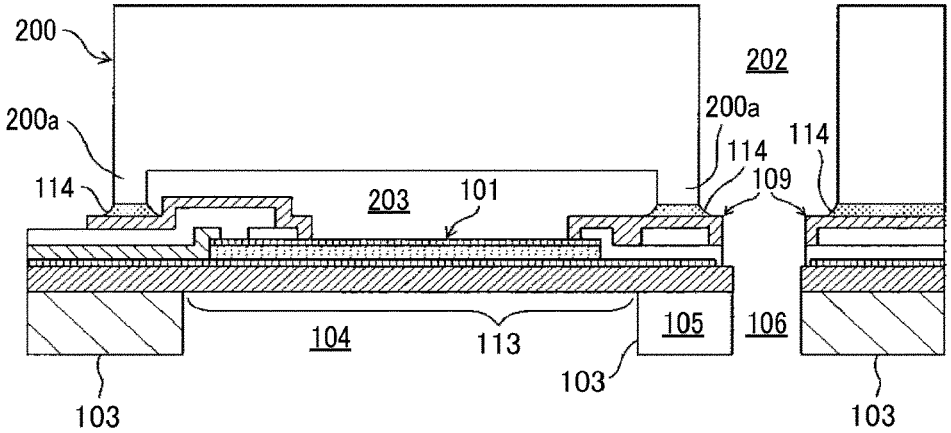

Next, as illustrated in FIG. 8B, partition walls 103 other than the pressure chamber 104, the common chamber 106, and the fluid restrictors 105 are covered with a resist by photolithography. Anisotropic wet etching is performed with an alkaline solution such as potassium hydroxide (KOH) solution or tetramethylammonium hydroxide (TMHA) solution to form the pressure chambers 104, the common chamber 106, and the fluid restrictors 105.

Figure 8C:
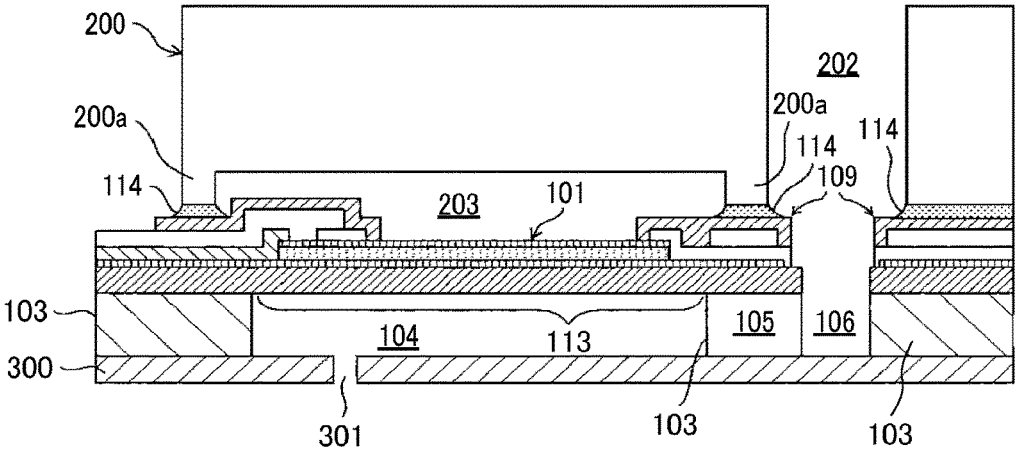

In addition to anisotropic etching using an alkaline solution, the pressure chambers 104, the common chamber 106, and the fluid restrictors 105 may be formed by, for example, dry etching using an Inductive Coupled Plasma (ICP) etcher. Then, as illustrated in FIG. 8C, the nozzle substrate 300, in which nozzles 301 are formed, is bonded to the actuator substrate 100 such that positions of the nozzles 301 corresponds to positions of the pressure chambers 104, respectively.

The above description is but an example of a method of manufacturing a head, and the present embodiment is not limited to the embodiment described above.

Next, a configuration of a bonding region where the holding substrate 200 is bonded to the actuator substrate 100 is described below.

When connecting portion between the driving IC 120 and the individual electrode pad 107 formed at the end portion of the lead wire 108 is subjected to an external force (e.g., by bending or impact, etc.), connection between the driving IC 120 and the individual electrode pad 107 tends to be broken. Further, the connection between the driving IC 120 and the individual electrode pad 107 may be disconnected due to thermal stress. Further, moisture may adhere to the connecting portion between the driving IC 120 and the individual electrode pad 107 due to temperature and humidity changes, and thus the connecting portion may be corroded. Therefore, the connecting portion between the driving IC 120 and the individual electrode pad 107 needs to be sealed and reinforced with a sealant.

As illustrated in FIG. 9, the holding substrate 200 includes an IC accommodating portion 201 for accommodating the driving IC 120 in the present embodiment. As illustrated in FIG. 4, the sealant 130 is placed in the IC accommodating portion 201 of the holding substrate 200. Further, the connecting portion between the driving IC 120 and the individual electrode pad 107 is covered and sealed with a sealant 130.

In the present embodiment, it is important to bond the leg portions 200*a* of the recesses 203 formed in the holding substrate 200 to the bonding regions 109 on the actuator substrate 100 with an appropriate amount of the adhesive 114 without unevenness. Thus, it is necessary to confirm whether there is excessive adhesive 114 protruding from the bonding region 109 or whether there is a shortage of the adhesive 114 that bonds the leg portions 200*a* of the holding substrate 200 and the bonding region 109 of the actuator substrate 100 (adhesion status).

The quality of the bonding status can be determined, for example, by visual identification of fillet shape of the adhesive 114 interposed in a bonding portion. However, as illustrated in FIG. 10, it is difficult to visually identify the bonding portions between the leg portions 200*a* positioned between the piezoelectric elements 101 and the bonding region 109 on the actuator substrate 100 due to the presence of the holding substrate 200 among the leg portions 200*a* of the holding substrate 200.

Figure 25A:
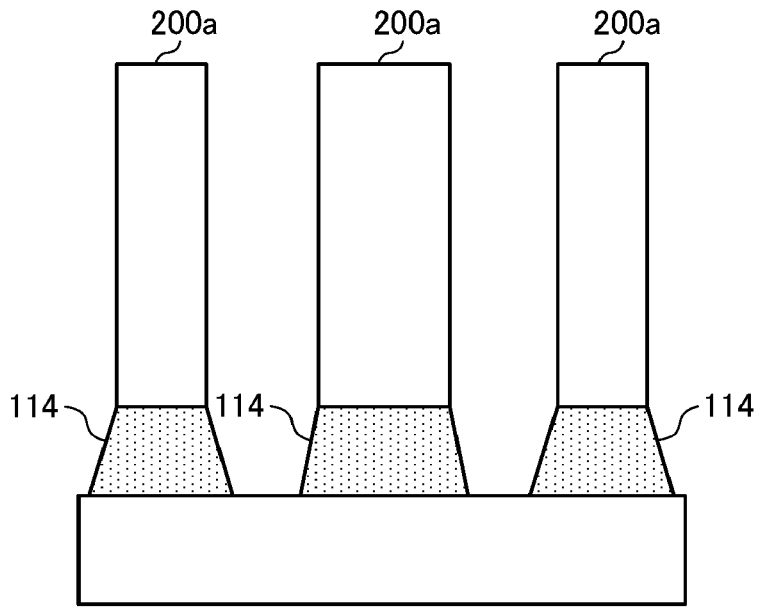
FIGS. 25A and 25B are explanatory cross-sectional views of the holding substrate and the actuator substrate in which the adhesive has moved along a side wall of the leg portion.
Figure 25B:
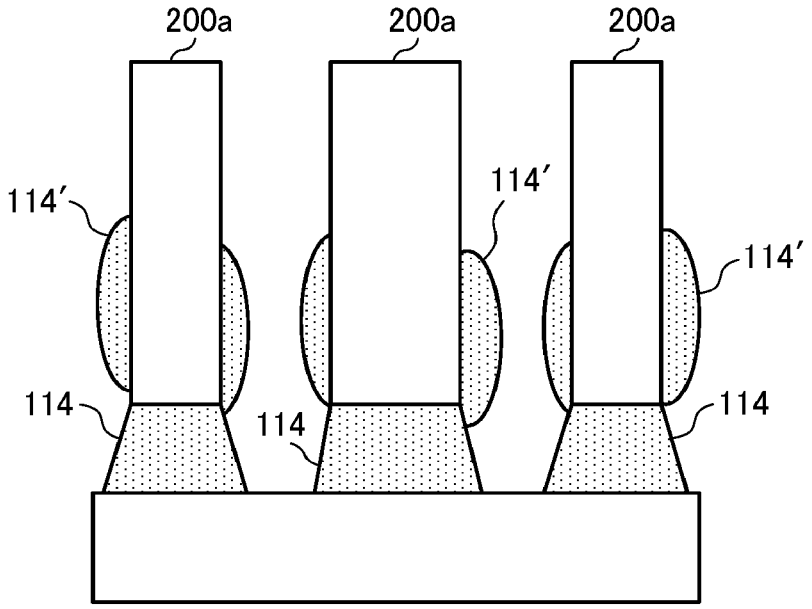

To observe the bonding portion that cannot be visually identify, there is a method in which the bonding portion is observed over the holding substrate 200 using an infrared microscope (IR microscope), for example. However, the above-described method cannot identify the fillet shape of the adhesive 114 since the image observed by the IR microscope is unclear. Further, as illustrated in FIGS. 25A and 25B, the fillet shape of the adhesive 114 cannot be visually identified by any surplus adhesive 114' moving along the side walls of the leg portions 200*a* even if the fillet shape of the adhesive 114 is observed through the holding substrate 200 with the IR microscope.

Thus, as illustrated in FIG. 2, the present embodiment includes a checking structure 115 for checking the bonding status on the first substrate 100' on which the actuator substrate 100 is formed. The checking structure 115 is formed on a corner (upper right in FIG. 2) of a surface of the first substrate 100' facing the second substrate 200' on which the holding substrate 200 is formed. The checking structure 115 has a plurality of surface portions each having different heights. The checking structure 115 in the present embodiment includes four surface portions 115*a* to 115*d* such as a first surface portion 115*a*, a second surface portion 115*b*, a third surface portion 115*c*, and a fourth surface portion 115*d* each having different heights.

The four surface portions 115*a* to 115*d* includes the first surface portion 115*a* having a height identical to a height of bonding surface of the first substrate 100' (actuator substrate 100) to be bonded by the adhesive 114 applied to the second substrate 200' (holding substrate 200). The four surface portions 115*a* to 115*d* includes the second surface portion 115*b* (excess detection surface) serving to inspect excessive adhesion has a height at which the adhesive 114 applied to the second substrate 200' comes into contact with the second surface portion 115*b* when the adhesive 114 is excessive and has a height at which the adhesive 114 applied to the second substrate 200' does not come into contact with the second surface portion 115*b* when the adhesive 114 is not excessive.

The four surface portions 115*a* to 115*d* includes the third surface portion 115*c* (insufficiency detection surface) serving to inspect insufficient adhesion has a height at which the adhesive 114 applied to the second substrate 200' does not comes into contact with the third surface portion 115*c* when the adhesive 114 is insufficient and has a height at which the adhesive 114 applied to the second substrate 200' comes into contact with the third surface portion 115*c* when the adhesive 114 is not insufficient.

Thus, according to the present embodiment, it is possible to confirm that the bonding is insufficient by checking whether the adhesive 114 applied to the second substrate 200' does not contact the third surface portion 115*c*. Further, it is possible to confirm that the bonding is excessive by confirming that the adhesive 114 applied to the second substrate 200' is in contact with the second surface portion 115*b*. Further, it is possible to confirm that the bonding is appropriate by confirming that the adhesive 114 applied to the second substrate 200' is in contact with the third surface portion 115*c* and not in contact with the second surface portion 115*b*.

Note that a position of providing the checking structure 115 is not limited to the example illustrated in FIG. 2 and the position can be set as appropriate as long as the checking structure 115 is provided at a position facing the second substrate 200' on which the holding substrate 200 is formed. For example, the checking structure 115 may be formed outside a region where the piezoelectric element 101 is formed. At the same time, the checking structure 115 is arranged at an end in an arrangement direction of the piezoelectric elements 101 (in a longitudinal direction of the actuator substrate 100) on the first substrate 100' on which the actuator substrate 100 is formed. Particularly, the checking structure 115 may be provided at both end regions in the arrangement direction of the piezoelectric elements 101.

Hereinafter a description is given of a bonded substrate used for manufacturing the electromechanical transducer substrate of the head 10

Figure 11:
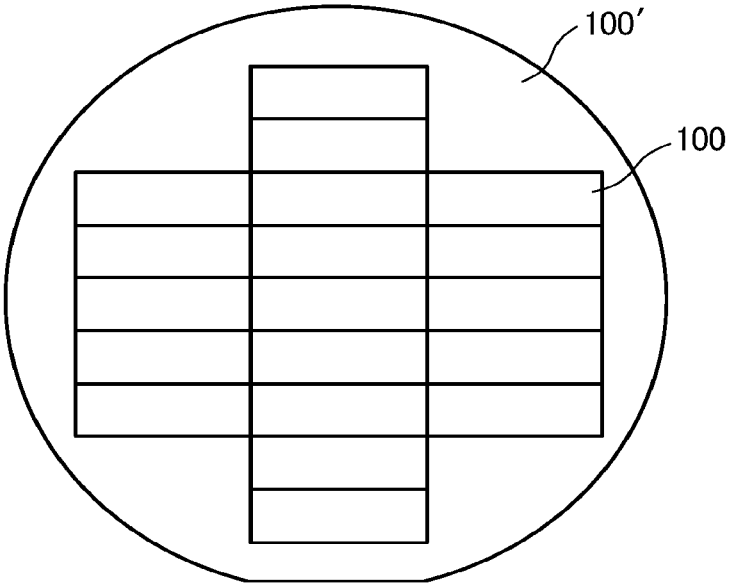
FIG. 11 is a schematic plan view of the first substrate on which the actuator substrate is formed.

FIG. 11 is a schematic plan view of the first substrate 100' on which the actuator substrate 100 is formed.

Figure 12:
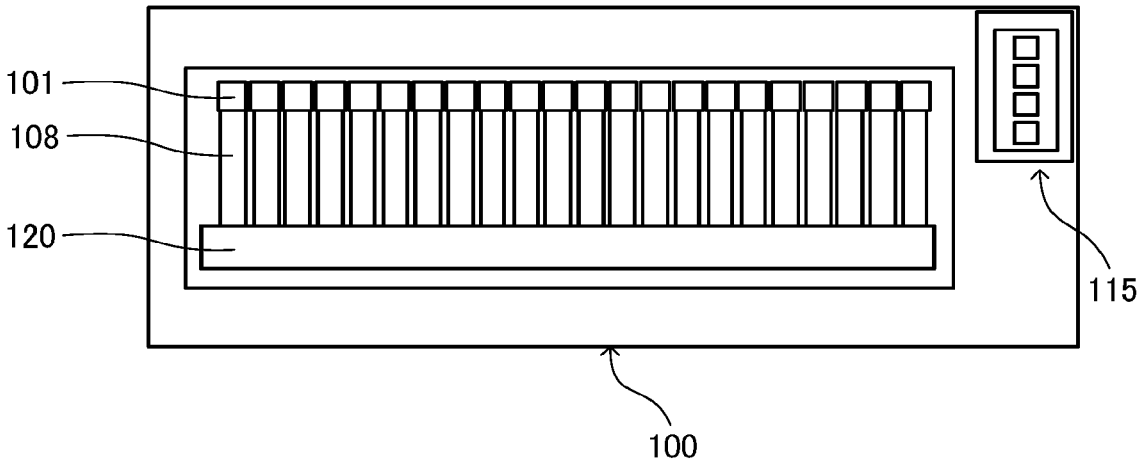
FIG. 12 is an enlarged schematic plan view of one actuator substrate formed on the first substrate.

FIG. 12 is an enlarged schematic plan view of one actuator substrate 100 formed on the first substrate 100'.

Figure 13:
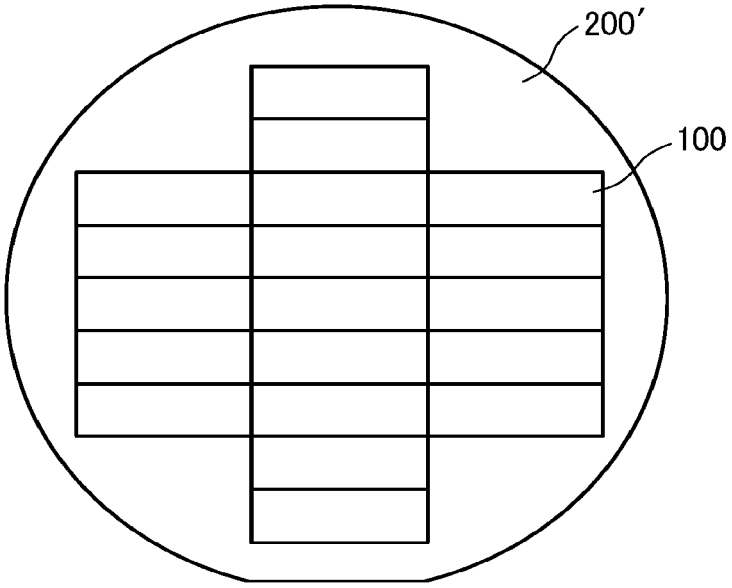
FIG. 13 is a schematic plan view of the second substrate on which the holding substrate is formed.

FIG. 13 is a schematic plan view of the second substrate 200' on which the holding substrate 200 is formed.

Figure 14:
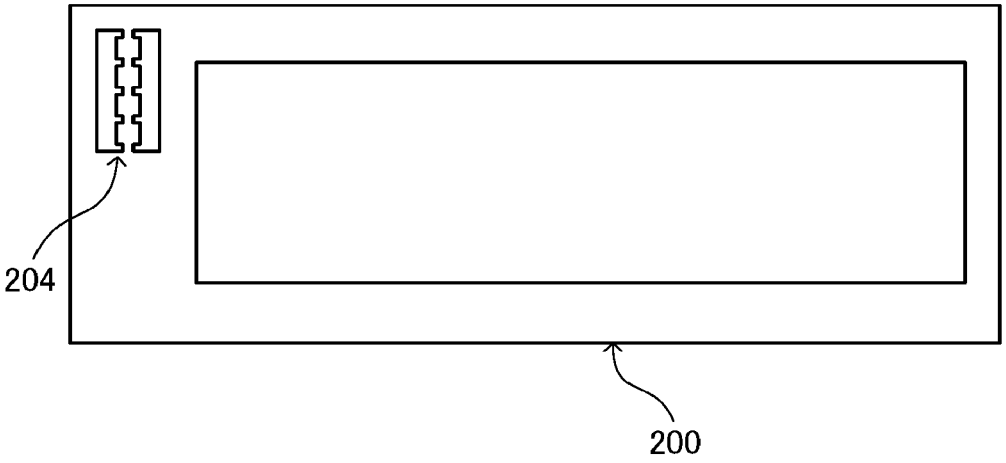
FIG. 14 is an enlarged schematic plan view of one holding substrate formed on the second substrate.

FIG. 14 is a schematic enlarged plan view of one holding substrate 200 formed on the second substrate 200'.

Both the first substrate 100' and the second substrate 200' are 6-inch silicon substrates. In the present embodiment, as illustrated in FIG. 11, nineteen chips (actuator substrates 100) are arranged on the first substrate 100'. As described above, the chips (actuator substrates 100) are laminated layer structures formed by sequentially forming a plurality of films. Further, the checking structure 115 described above is provided at the corner (upper right in FIG. 12) of the chips (actuator substrate 100).

Conversely, as illustrated in FIG. 13, the holding substrates 200 are formed on the second substrate 200' at positions corresponding to the chips (actuator substrates 100) on the first substrate 100'. An opposing surface portion 204 to which the adhesive 114 is applied is provided on a corner (upper left in FIG. 14) of the holding substrate 200 to face the checking structure 115 on the first substrate 100'.

Figure 15:
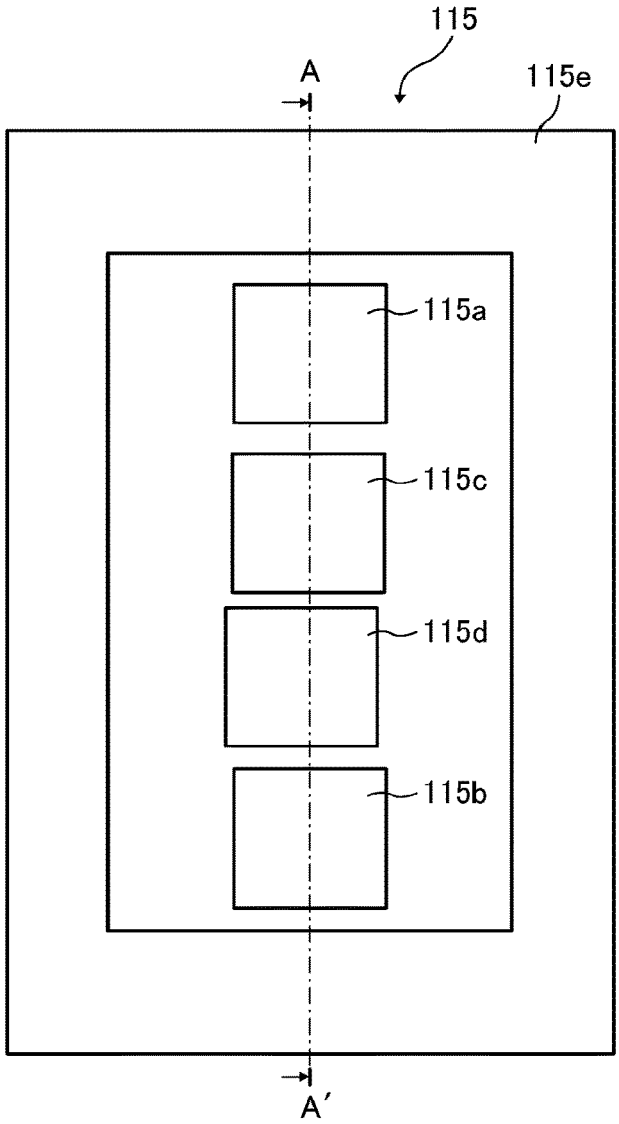
FIG. 15 is an enlarged schematic plan view of a checking structure to check an adhesion state of the first substrate.

FIG. 15 is a schematic enlarged plan view of the checking structure 115 on the first substrate 100'.

Figure 16:
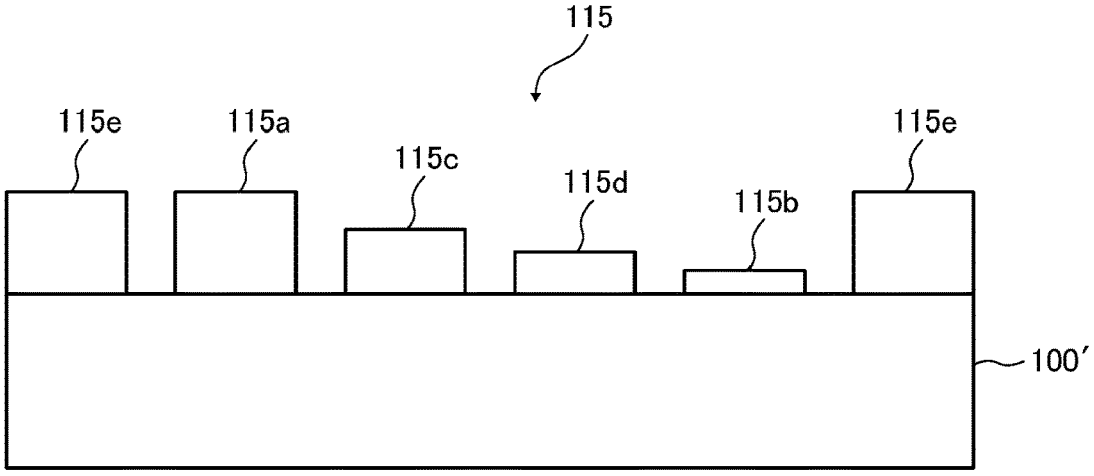
FIG. 16 is a cross-sectional view along a line A-A' in FIG. 15.

FIG. 16 is a cross-sectional view along a line A-A' in FIG. 15.

In the checking structure 115, four types of films are individually processed on a base of the first substrate 100' by photolithography to form four surface portions 115*a* to 115*d* each having different heights. In the present embodiment, the height of the first surface portion 115*a* is 4 μm, the height of the second surface portion 115*b* is 1 μm, and the height of the third surface portion 115*c* is 3 μm. The fourth surface portion 115*d* is also provided as another surface portion that has a height lower than the height of the third surface portion 115*c* and higher than the height of the second surface portion 115*b*. The height of the fourth surface portion 115*d* is 2 μm.

The four surface portions 115*a* to 115*d* are arranged in an order of height in the checking structure 115 of the present embodiment. However, no functional change occurs even when the order of arrangement of the four surface portions 115*a* to 115*d* is changed. The height of the first surface portion 115*a* is set at the same height as the bonding region 109 of the actuator substrate 100 to which the leg portion 200*a* of the holding substrate 200 is bonded. The first surface portion 115*a* serves as a bonding interface with the second substrate 200'.

Further, the checking structure 115 includes a bonding surface portion 115*e* that is a bonding surface portion to enclose the four surface portions 115*a* to 115*d*. This bonding surface portion 115*e* is a portion to be bonded to a bonding surface portion 204*e* formed on the opposing surface portion 204 of the second substrate 200' by the adhesive 114. The height of the bonding surface portion 115*e* is the same height as the height of the first surface portion 115*a* and can function as the first surface portion.

Figure 17:
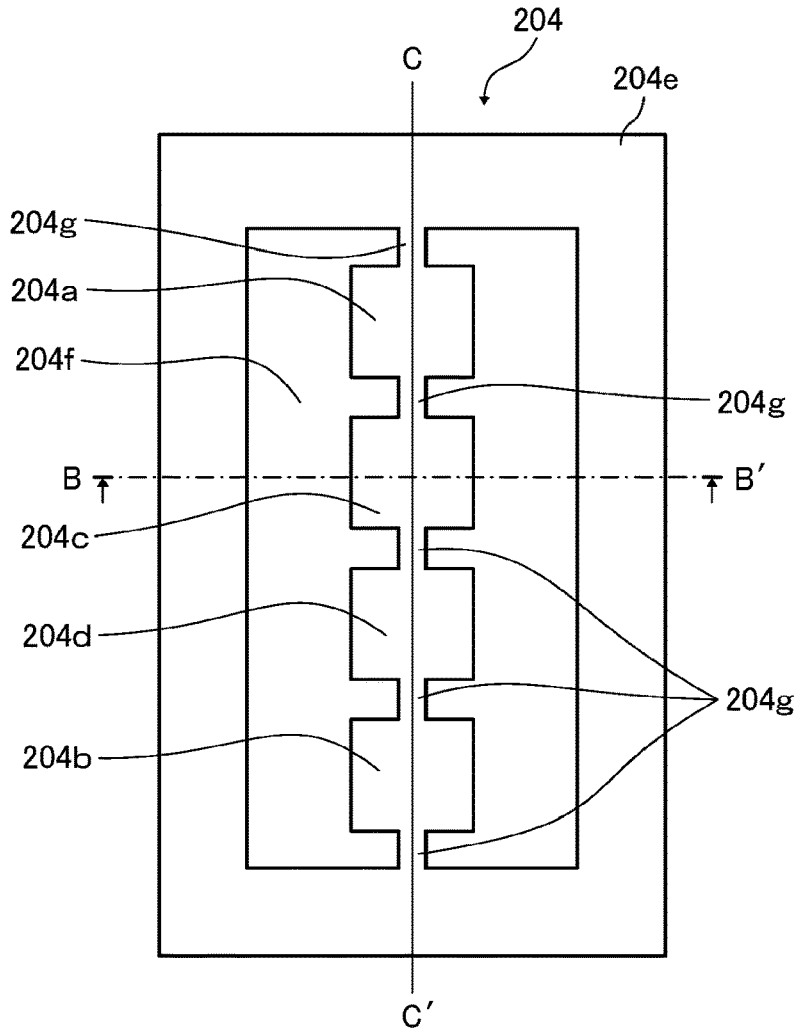
FIG. 17 is an enlarged schematic plan view of a facing surface portion of the second substrate.

FIG. 17 is a schematic enlarged plan view of a facing surface portion 204 of the second substrate 200'.

Figure 18:
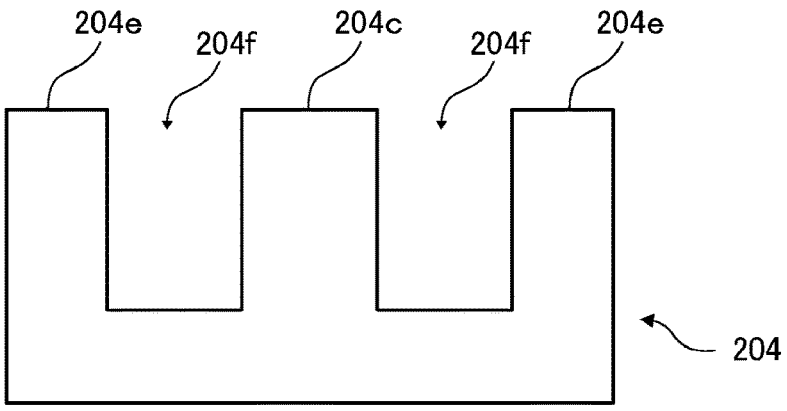
FIG. 18 is a cross-sectional view of the facing surface portion along the line B-B' in FIG. 17.

FIG. 18 is a cross-sectional view of the facing surface portion 204 along the line B-B' in FIG. 17.

The facing surface portion 204 of the second substrate 200' in the present embodiment includes wide portions 204*a*, 204*b*, 204*c*, and 204*d* to be bonded to surface portions 115*a*, 115*b*, 115*c*, and 115*d* on the checking structure 115 of the first substrate 100', respectively, by the adhesive. As illustrated in FIGS. 17 and 18, each of the wide portions 204*a*, 204*b*, 204*c*, and 204*d* includes a flat surface having the same height on a top of each of the wide portions 204*a*, 204*b*, 204*c*, and 204*d*.

Further, the facing surface portions 204 in the present embodiment includes a concave portion 204*f* having a height lower than the facing surface portion 204 (the wide portions 204*a* to 204*d*) in at least a part of a periphery of the wide portions 204*a* to 204*d*. Further, the facing surface portions 204 in the present embodiment include a connection portions (narrowed portions 204*g*) between the wide portions

204*a* to 204*d*, between the wide portion 204*a* and a bonding surface portion 204*e*, and between the wide portion 204*b* and the bonding surface portion 204*e*. The facing surface portion 204 is processed by a photolithography method.

In this embodiment, the adhesive 114 for bonding the first substrate 100' and the second substrate 200' is thin-film transferred to an entire surface of the second substrate 200' by flexography. As illustrated in FIGS. 17 and 18, in the facing surface portion 204 of the present embodiment, the portions other than the concave portion 204*f* (the wide portions 204*a* to 204*d*, the narrowed portion 204*g*, and the bonding surface portion 204*e*) have the same height. An adhesive 114 is applied to the portions other than the concave portion 204*f* (the wide portions 204*a* to 204*d*, the narrowed portion 204*g*, and the bonding surface portion 204*e*). However, no adhesive is applied to the concave portion 204*f*.

In the present embodiment, the narrowed portion 204*g* facilitates measurement of an amount (thickness) of the adhesive 114 applied to the second substrate 200'. More specifically, the narrowed portion 204*g* makes the facing surface portion 204 to have uniform height without steps along a direction of the line C-C' in FIG. 17. Thus, unevenness of thickness of the adhesive 114 applied to the facing surface portion 204 in the direction of the line C-C' in FIG. 17 can be measured by measuring unevenness of upper surface of the adhesive 114 in the direction of C-C' in FIG. 17. The unevenness of thickness of the adhesive 114 can be easily measured using a general step gauge or the like. Note that the narrowed portion 204*g* is not necessary when the thickness of the adhesive 114 applied to the facing surface portion 204 is measured by optical measurement or the like.

Figure 19A:
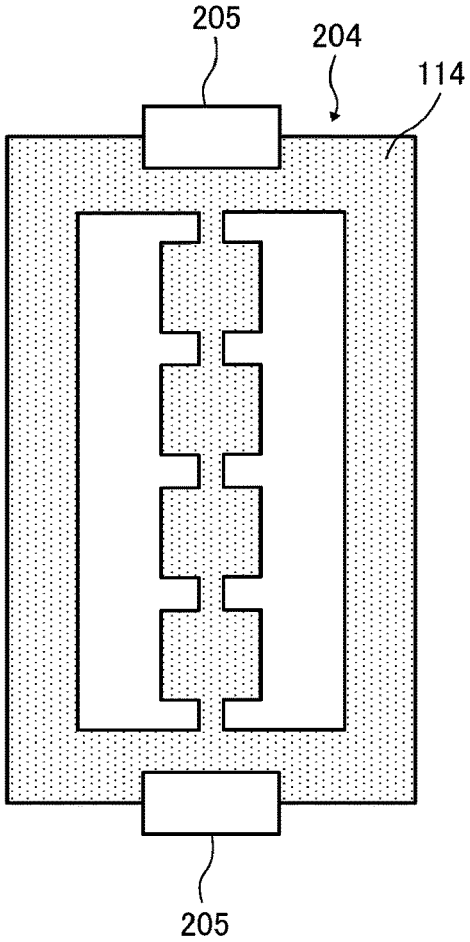
FIG. 19A is a schematic enlarged plan view of the facing surface portion of the second substrate to which adhesive is applied after pieces of tape are adhered.

FIG. 19A is a schematic enlarged plan view of the facing surface portion 204 of the second substrate 200' to which the adhesive is applied after pieces of tape 205 are adhered.

Figure 19B:
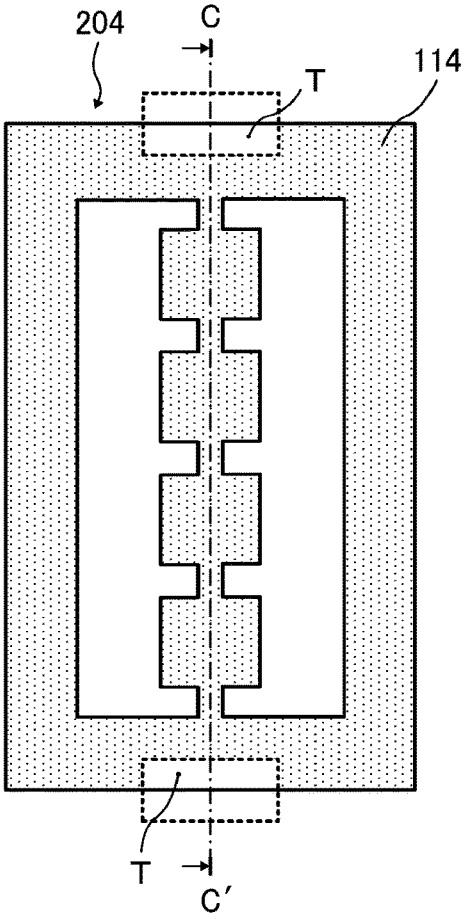
FIG. 19B is a schematic enlarged plan view of the facing surface portion of the second substrate from which the pieces of tape are removed after the adhesive is applied.

FIG. 19B is a schematic enlarged plan view of a facing surface portion 204 of the second substrate 200' from which the pieces of tape 205 are removed after the adhesive 114 is applied.

Figure 20:
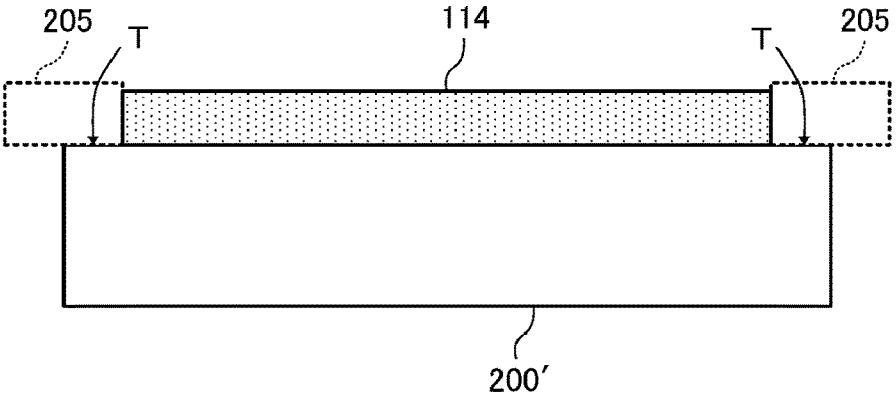
FIG. 20 is a cross-sectional view of the facing surface portion along the line C-C' in FIG. 19B.

FIG. 20 is a cross-sectional view of the facing surface portion 204 along the line C-C' in FIG. 19B.

It is necessary to obtain a reference surface T to be a reference of thickness of the adhesive 114 when the unevenness of thickness of the adhesive 114 applied to the facing surface portion 204 is measured in the direction of the line C-C' in FIG. 19B by using the step gauge, for example. Therefore, as illustrated in FIGS. 19A and 19B, the pieces of tape 205 are previously adhered on both ends (upper and lower ends in FIGS. 19A and 19B) of the bonding surface portion 204*e* in the same line (the line C-C' in FIGS. 19A and 19B) of the wide portions 204*a* to 204*d* and the narrowed portion 204*g* before applying the adhesive 114 on the second substrate 200'. Then, as illustrated in FIG. 19B, the pieces of tape 205 are removed after applying the adhesive 114 on the second substrate 200'.

Thus, the bonding surface portion 204*e* before the adhesive 114 is applied can be obtained at positions where the pieces of tape 205 were adhered. The bonding surface portion 204*e* where the tape 205 was adhered can be used as the reference surface T for measuring the thickness of the adhesive 114.

The thickness of the adhesive 114 in this embodiment is preferably about 3 μm. However, a suitable thickness of the adhesive 114 may be set as appropriate.

In the present embodiment, the concave portion 204*f* is formed around the wide portions 204*a* to 204*d* to allow excessive adhesive 114 applied to the facing surface portion 204 of the second substrate 200' to enter the concave portion 204*f* when the first substrate 100' and the second substrate 200' are bonded to each other. Specifically, an entire area of the facing surface portion 204 of the second substrate 200' may be formed with a uniform plane without providing the concave portion 204*f*. Then, the excessive adhesive 114 moves in a planar direction, and the excessive adhesive 114 may move to a surface portion among the four surface portions 115*a* to 115*d* of the checking structure 115 of the first substrate 100' with which the adhesive 114 should not come into contact. Thus, an adequacy of an adhesion status may not be accurately determined. Providing the concave portion 204*f* as in the present embodiment can prevent occurrence of the situation as described above. Thus, it is possible to accurately determine the adequacy of adhesion status.

Figure 21:
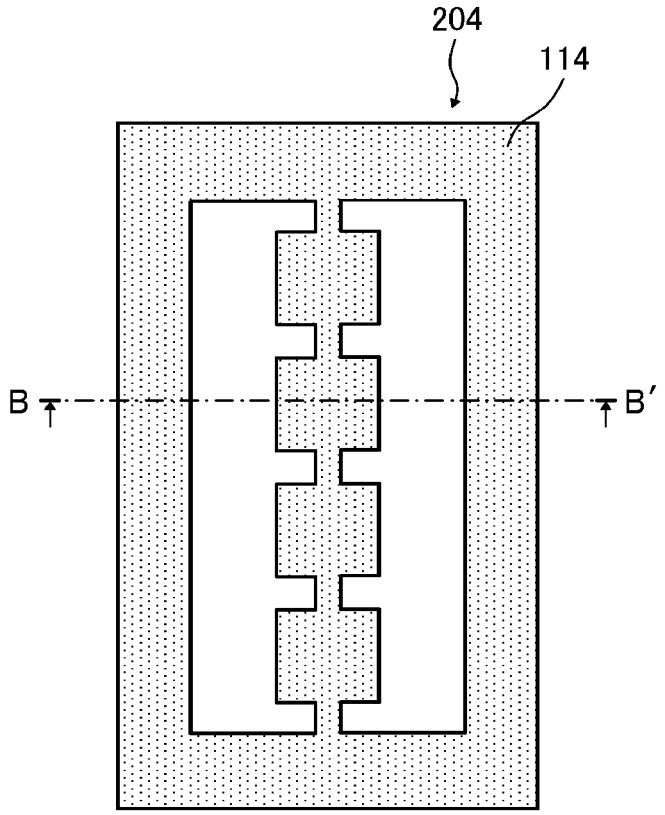
FIG. 21 is a plan view of the facing surface portion of the second substrate on which an adhesive is applied by patterning, an entire area of the facing surface portion having a uniform flat surface.
Figure 22:
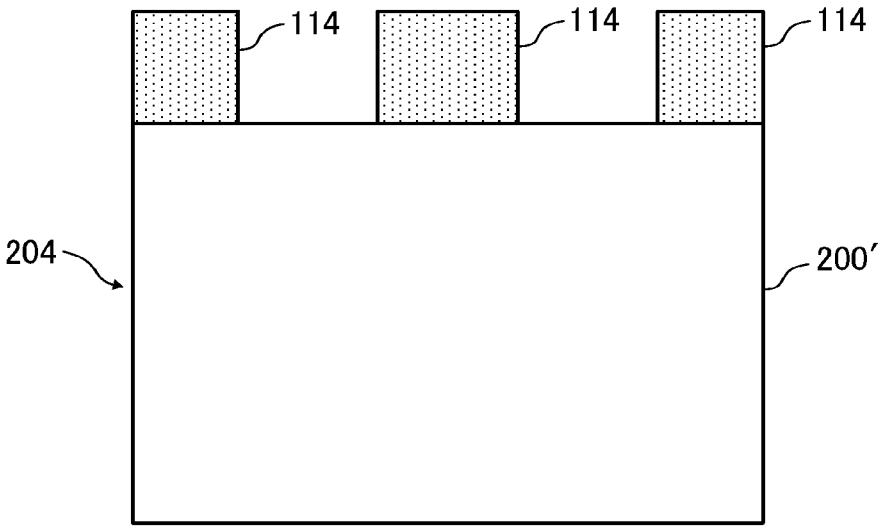
FIG. 22 is a cross-sectional view of the facing surface portion along the line B-B' in FIG. 17.

However, even when the entire area of the facing surface portion 204 of the second substrate 200' is formed in a uniform plane without the concave portion 204*f*, the above-described situation may not occur when the adhesive 114 is applied to the facing surface portion 204 with a pattern as illustrated in FIGS. 21 and 22. Thus, the concave portion 204*f* becomes not necessarily. The pattern of the adhesive 114 has a shape covering the wide portions 204*a* to 204*d*, the narrowed portions 204*g*, and the bonding surface portion 204*e*.

Figure 23:
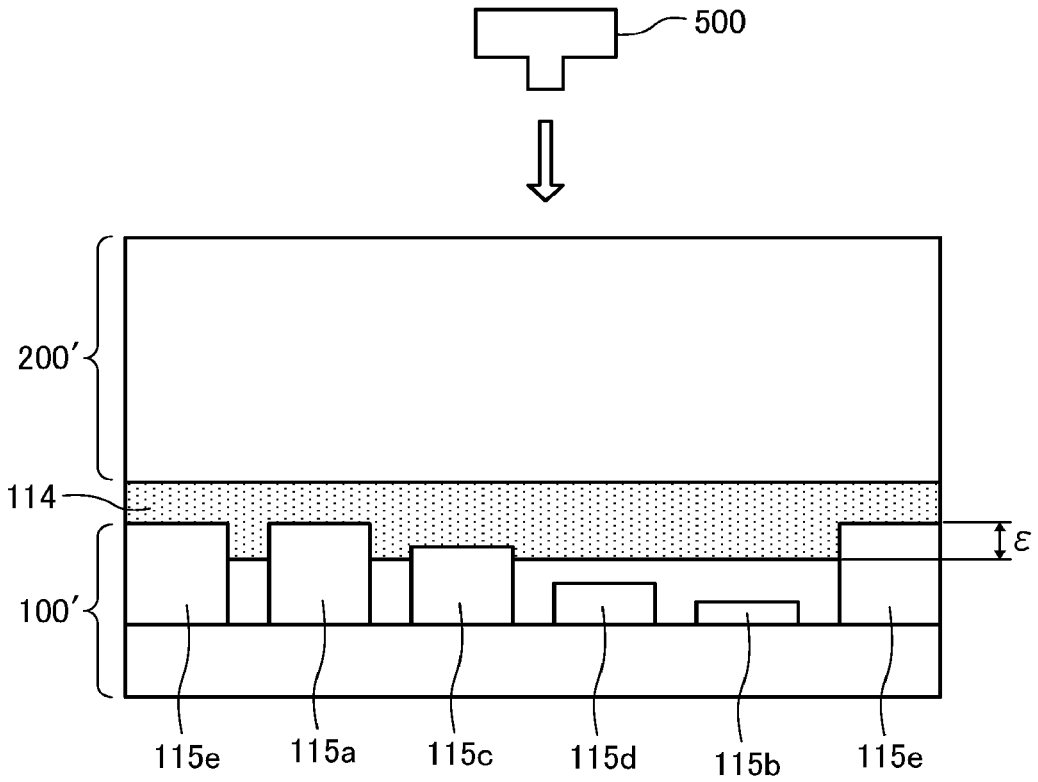
FIG. 23 is a cross-sectional view of a portion in which the checking structure and the facing surface portion are bonded to each other when the first substrate and the second substrate to which the adhesive is applied are bonded.

FIG. 23 is a cross-sectional view of a portion of the checking structure 115 and the facing surface portion 204 in a state in which the checking structure 115 and the facing surface portion 204 are bonded to each other when the first substrate 100' and the second substrate 200' to which the adhesive 114 is applied are bonded to each other. As described above, the second substrate 200' of the present embodiment is a silicon substrate and has a light-transmissive property to transmit infrared light.

Further, the facing surface portion 204 has a light-transmissive property to transmit infrared light.

Thus, the checking structure 115 is observed through the second substrate 200' using an infrared (IR) microscope 500. Through an observation of the second substrate 200', it can be checked to which height the adhesive 114 reaches (contacts) the surface portion among the surface portions 115*a* to 115*d* each having different heights. Thus, checking to which height the adhesive 114 reaches (contacts) the surface portion enable ascertain of whether or not a state of adhesion is appropriate (whether the state of adhesion is excessive, insufficient, or appropriate).

In an example of FIG. 23, the adhesive 114 is in contact with the third surface portion 115*c* that has a height next to the first surface portion 115*a*. Thus, the adhesive 114 contacts the first surface portion 115*a*, the third surface portion 115*c*, and the bonding surface portion 115*e*. The adhesive 114 does not contact with the fourth surface portion 115*d* that has a height next to the third surface portion 115*c*. The fourth surface portion 115*d* is higher than the second surface portion 115*b* and lower than each of the first surface portion 115*a* and the third surface portion 115*c*.

Thus, it can be confirmed that a pushing amount ε of at least 1 μm is obtained. The pushing amount ε is a pushing amount (pushed height) of the adhesive 114 adhered on the bonding surface portion 204*e* of the second substrate 200' pushed by the bonding surface portion 115*e* of the first substrate 100' when the first substrate 100' and the second substrate 200' are bonded to each other. Thus, a height of the adhesive 114 adhered on the bonding surface portion 204*e* and pushed by the bonding surface portion 115*e* is reduced by the pushing amount ε.

The height of the bonding surface portion 115*e* of the first substrate 100' is the same height as the bonding region 109. The height of the bonding surface portion 204*e* of the second substrate 200' is the same as the height of the leg portion 200*a* bonded to the bonding region 109. Thus, the pushing amount s corresponds to a pushing amount ε of the adhesive 114 in a bonding portion of the bonding region 109 and the leg portion 200*a*.

In the present embodiment, when the pushing amount ε is 1 μm or more, there is no gap (space) between the adhesive 114 applied to the second substrate 200' and the first substrate 100' when the second substrate 200' applied with the adhesive 114 and the first substrate 100' are bonded to each other. Thus, it is determined that the state of adhesion is insufficient. The adhesive 114 may have a wavy, uneven shape after being applied to the second substrate 200' according to type of the adhesive 114. For example, even if the thickness of the adhesive 114 is 3 μm on average, the thickness of the adhesive 114 may actually vary within a range from 2.5 μm to 3.5 μm.

Even in the above-described case, a pushing amount of 0.5 μm or more is secured even at a position at which the thickness of the adhesive 114 is the minimum value of 2.5 μm if the pushing amount of 1 μm or more is obtained. Thus, it is possible to avoid a state of insufficient adhesion. The threshold value of the pushing amount ε may be set as appropriate according to the type of adhesive 114, the method of applying the adhesive 114, and the like.

In the present embodiment, the first substrate 100' and the second substrate 200', before the chips (actuator substrates 100) are cut out from the silicon substrate, are bonded to each other on a silicon substrate basis to improve production efficiency. However, the actuator substrate 100, after the chips (actuator substrates 100) are cut out from the silicon substrate, and the holding substrate 200 cut out from the second substrate 200' may be bonded to each other. In the above-described case, the actuator substrate 100 becomes the first substrate 100', and the holding substrate 200 becomes the second substrate 200'.

If the first substrate 100' and the second substrate 200' are bonded on a silicon substrate basis as in the present embodiment, the state of adhesion may vary depending on the position of bonding on the silicon substrate.

Figure 24A:
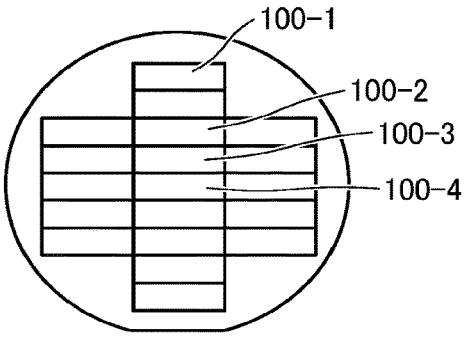
FIG. 24A illustrate four actuator substrates formed in different positions on a silicon substrate.
Figure 24B:
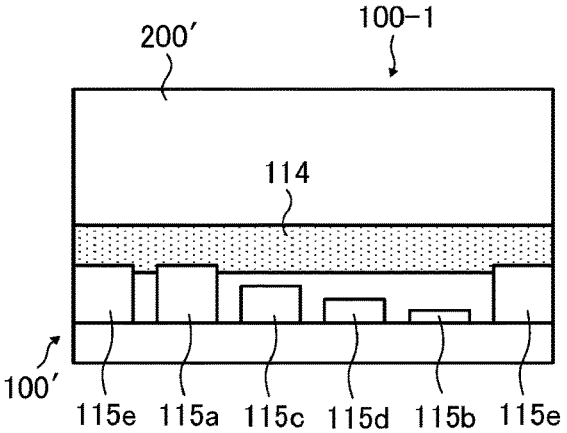
FIGS. 24B to 24E are cross-sectional views of a portion of the checking structure and the facing surface portion in a state in which the checking structure and the facing surface portion are bonded to each other in each of four actuator substrates.

FIGS. 24A to 24E illustrate the actuator substrates 100-1, 100-2, 100-3, and 100-4 that are four chips formed in different positions on the silicon substrate (first substrate 100'). For example, as illustrated in FIG. 24B, the adhesive 114 contacts the first surface portion 115*a* of the actuator substrate 100-1 close to an outer periphery of the silicon substrate. However, the adhesive 114 does not contact the third surface portion 115*c* having a height next to the first surface portion 115*a*. The third surface portion 115*c* serves as a surface portion for checking insufficient adhesion.

The state of adhesion between the actuator substrate 100-1 and the holding substrate 200 may be insufficient at a portion in which a thickness of the adhesive 114 is relatively thin when there is unevenness of the thickness of the adhesive 114 applied on the second substrate 200'. Thus, it is necessary to make the electromechanical transducer substrate including the actuator substrate 100-1 and the holding substrate 200 defective by appearance inspection.

Figure 24C:
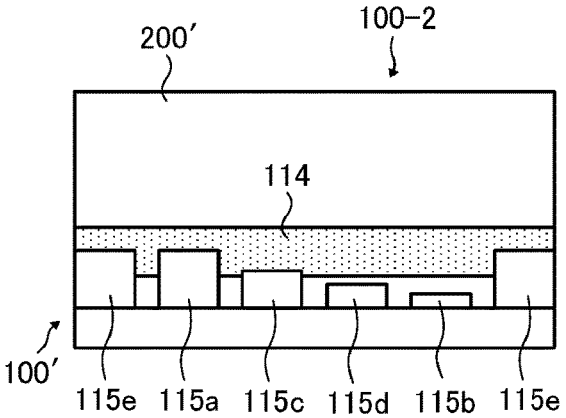

As illustrated in FIG. 24C, in the actuator substrate 100-2, the adhesive 114 contacts the third surface portion 115*c* as the surface portion for checking insufficient adhesion and does not contact the second surface portion 115*b* serving as a surface portion for checking excessive adhesion. Thus, it is determined that the state of adhesion is neither insufficient nor excessive, and the state of adhesion is in good condition (appropriate).

Figure 24D:
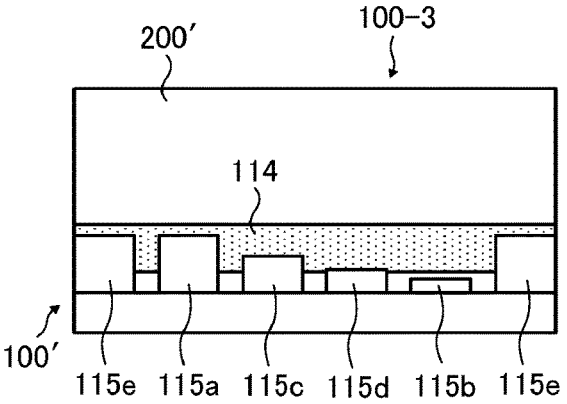

As illustrated in FIG. 24D, in the actuator substrate 100-3, the adhesive 114 contacts the third surface portion 115*c* as the surface portion for checking insufficient adhesion and does not contact the second surface portion 115*b* serving as a surface portion for checking excessive adhesion. Thus, it is determined that the state of adhesion is neither insufficient nor excessive, and the state of adhesion is in good condition (appropriate) in FIG. 24D.

Figure 24E:
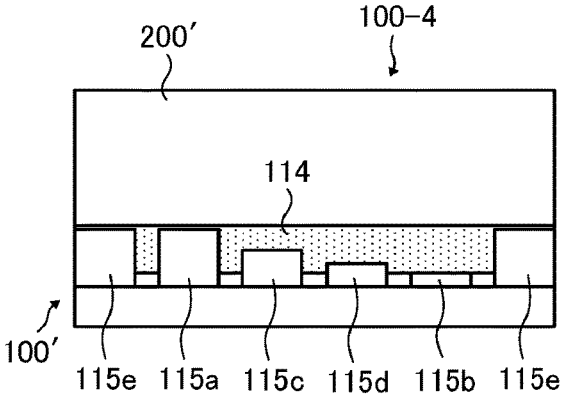

Conversely, as illustrated in FIG. 24E, in the actuator substrate 100-4, the adhesive 114 contacts the second surface portion 115*b* as the surface portion for checking excessive adhesion. Thus, the state of adhesion is excessive in FIG. 24E. Thus, it is necessary to make the electromechanical transducer substrate including the actuator substrate 100-4 and the holding substrate 200 defective by appearance inspection.

The present embodiment checks whether the adhesive 114 contacts the surface portions 115*a* to 115*d* of the checking structure 115 of the actuator substrate 100-1. Thus, the state of adhesion of the actuator substrate 100-1 can be checked. Thus, it is possible to appropriately determine that the electromechanical transducer substrate including the actuator substrate 100-1 and the holding substrate 200 is defective by appearance inspection.

In the present embodiment, the surface portions 115*a* to 115*d* of the checking structure 115 are formed by a process different from a process of forming the piezoelectric element of the actuator substrate 100, for example. However, the present embodiment is not limited to described-above. For example, each of the surface portions 115*a* to 115*d* of the checking structure 115 may be formed together with the piezoelectric element of the actuator substrate 100 during the film formation process of the piezoelectric elements of the actuator substrate 100.

When the surface portions 115*a* to 115*d* of the checking structure 115 are formed together with the piezoelectric element of the actuator substrate 100, each of the surface portions 115*a* to 115*d* of the checking structure 115 has a multiple layer structure including a plurality of layers. As described-above, to form the surface portions 115*a* to 115*d* having different heights, the number of layers of each of the surface portions 115*a* to 115*d* is made different. That is, the heights differ depending on the number of layers of the surface portions.

Thus, the first substrate 100' includes a plurality of layers on a substrate (actuator substrate 100). The insufficiency detection surface (third surface portion 115*c*) includes a part of the plurality of layers. The excess detection surface (second surface portion 115*b*) of the checking structure 115 includes a part of or none of the plurality of layers, a number of layers of which is smaller than a number of layers of the insufficiency detection surface (third surface portion 115*c*). The bonding surface portion 115*e* includes the plurality of layers, a number of layers of which is larger than the number of layers of the insufficiency detection surface (third surface portion 115*c*). The bonding surface portion 115*e* may include all the plurality of layers.

Further, the first substrate 100' includes a piezoelectric element 101 including a part of the plurality of layers, the part of the plurality of layers of the insufficiency detection surface (third surface portion 115*c*) includes the part of the plurality of layers of the piezoelectric element 101.

Figure 26:
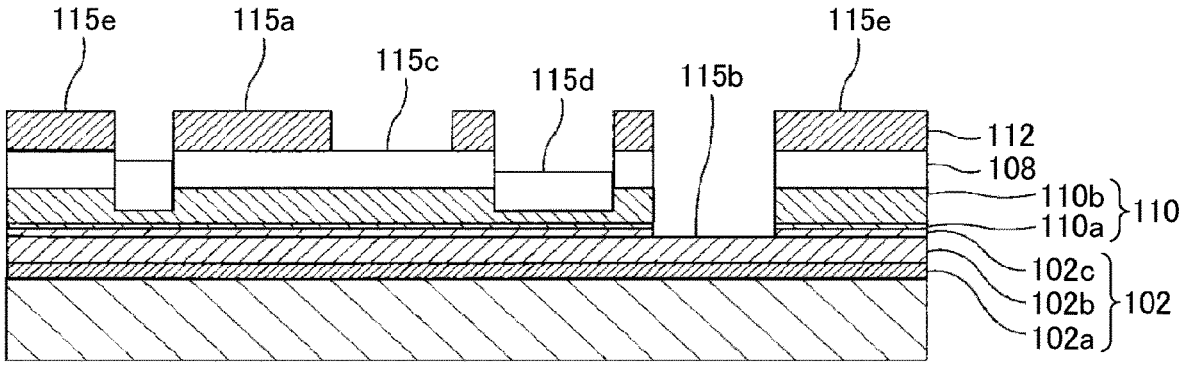
FIG. 26 is a cross-sectional view of an example of a layer structure of the facing surface portions of the checking structure formed together with a film forming process of the piezoelectric element of the actuator substrate.

FIG. 26 is a cross-sectional view of an example of a layer structure of the surface portions 115*a* to 115*d* of the checking structure 115. The surface portions 115*a* to 115*d* of the checking structure 115 is formed together with the piezoelectric element 101 of the actuator substrate 100 in the film formation process for forming the he piezoelectric element 101 of the actuator substrate 100.

Figure 27:
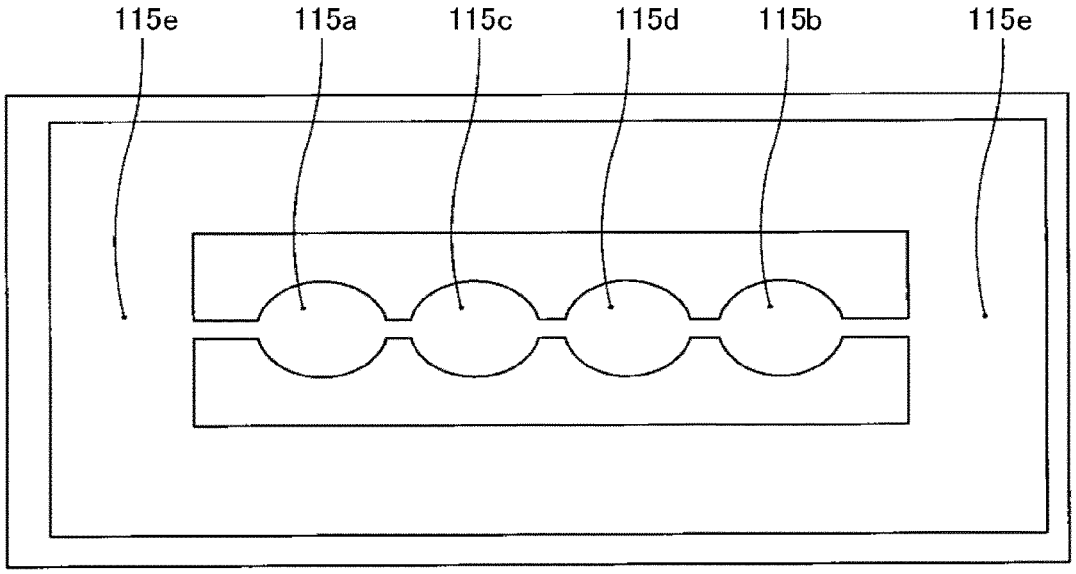
FIG. 27 is a plan view of the checking structure to check adhesion state in the example of FIG. 26.

FIG. 27 is a plan view of the checking structure 115 in the example of FIG. 26.

In the present embodiment, the first surface portion 115*a* and the bonding surface portion 115*e* include a three-layered diaphragm 102, an interlayer insulating film 110, a lead wire 108, and a passivation film 112 stacked in the above-described order from the bottom. The diaphragm 102 has three-layer formed on a silicon single crystal substrate. The interlayer insulating film 110 has a two-layer structure.

The diaphragm 102 has a three-layer structure including a $SiO_2$ film 102*a*, a Si layer 102*b*, and a $SiO_2$ film 102*c*. The interlayer insulating film 110 has a two-layer structure including an $Al_2O_3$ film (first insulating protective film 110*a*) and a SiN film (second insulating protective film 110*b*). The lead wire 108 has a single-layer structure of Al. The passivation film 112 is a single layer of SiN.

In the present embodiment, the second surface portion 115*b* has a structural body in which a $SiO_2$ film 102*a* and a Si layer 102*b* are laminated. The $SiO_2$ film 102*a* and the Si layer 102*b* form the diaphragm 102 having the three-layer structure on a silicon single crystal substrate. The second surface portion 115*b* is lower than each of the first surface portion 115*a* and the bonding surface portion 115*e* by a thickness of the $SiO_2$ film 102*c* of the diaphragm 102 having three-layer structure, the interlayer insulating film 110 having two-layer structure, the lead wire 108, and the passivation film 112.

In the present embodiment, the third surface portion 115*c* has a structural body in which the diaphragm 102 having the three-layer structure formed on the silicon single crystal substrate, the interlayer insulating film 110 having the two-layer structure, and the lead wire 108 are laminated. The third surface portion 115*c* is lower than each of the first surface portion 115*a* and the bonding surface portion 115*e* by a thickness of a layer of the passivation film 112.

In the present embodiment, the fourth surface portion 115*d* has a structural body in which the diaphragm 102 having the three-layer structure formed on the silicon single crystal substrate, the interlayer insulating film 110 having the two-layer structure, and the passivation film 112 are laminated. The fourth surface portion 115*d* is lower than each of the first surface portion 115*a* and the bonding surface portion 115*e* by a thickness of a layer of the lead wire 108.

Further, in the present embodiment, the respective surface portions 115*a* to 115*d* of the checking structure 115 are connected by connecting portions (narrowed portions 204*g*).

Figure 28:
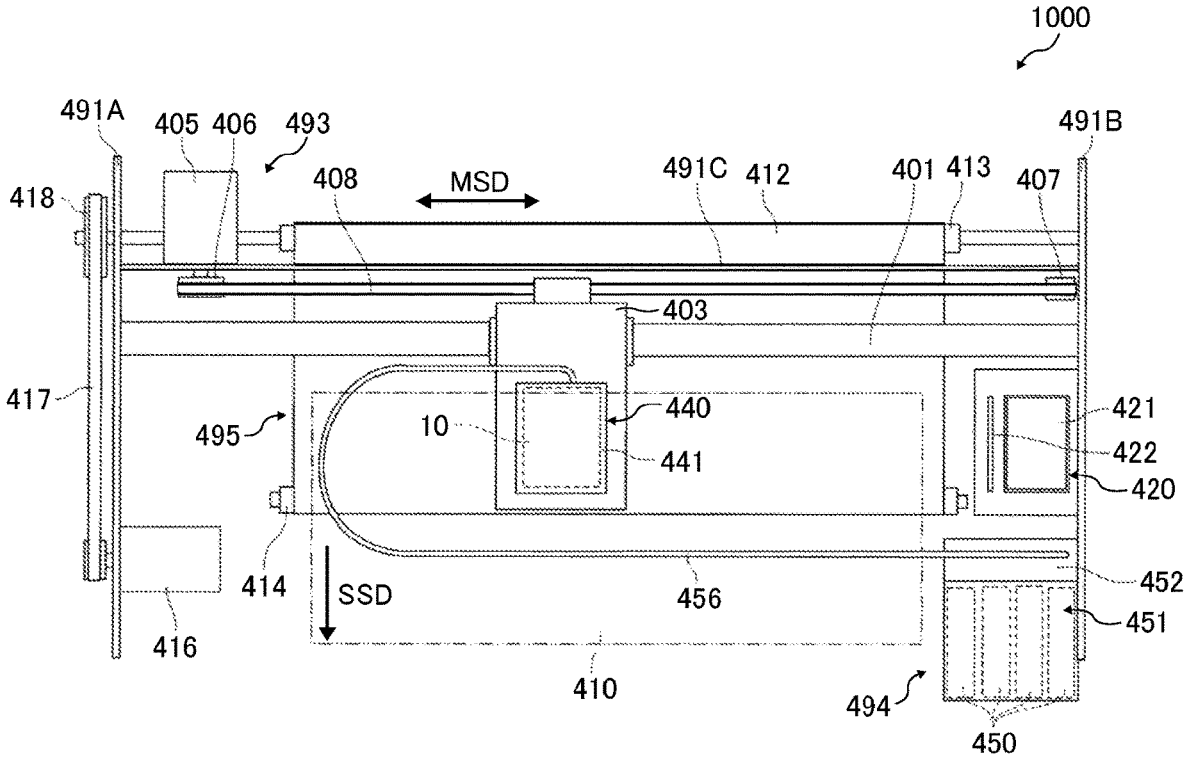
FIG. 28 is a plan view of a portion of a liquid discharge apparatus according to the embodiments.
Figure 29:
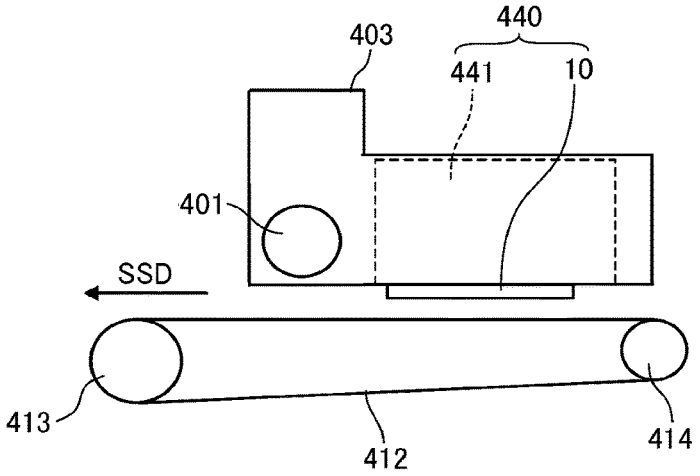
FIG. 29 is an explanatory side view of a portion of an example of a liquid discharge device.

Next, a liquid discharge apparatus 1000 according to a present embodiment is described with reference to FIGS. 28 and 29. FIG. 28 is a plan view of a portion of the liquid discharge apparatus 1000. FIG. 29 is a side view of a portion of the liquid discharge apparatus 1000 of FIG. 28.

A liquid discharge apparatus 1000 according to the present embodiment is a serial-type apparatus in which a main scan moving unit 493 reciprocally moves a carriage 403 in a main scanning direction indicated by arrow MSD in FIG. 28. The main scan moving unit 493 includes a guide 401, a main scanning motor 405, and a timing belt 408, for example. The guide 401 is bridged between a left side plate 491A and a right side plate 491B that movably holds the carriage 403. The main scanning motor 405 reciprocally moves the carriage 403 in the main scanning direction MSD via the timing belt 408 bridged between a driving pulley 406 and a driven pulley 407.

The carriage 403 mounts a liquid discharge device 440. The head 10 according to the present embodiment and a head tank 441 forms the liquid discharge device 440 as a single unit. The head 10 of the liquid discharge device 440 discharges liquid of each color, for example, yellow (Y), cyan (C), magenta (M), and black (K). The head 10 includes nozzle arrays each including a plurality of nozzles 301 arrayed in row in a sub-scanning direction, which is indicated by arrow SSD in FIG. 28, perpendicular to the main scanning direction MSD. The head 10 is mounted to the carriage 403 so that ink droplets are discharged downward.

The liquid stored in liquid cartridges 450 are supplied to the head tank 441 by a supply unit 494 for supplying the liquid stored outside the head 10 to the head 10.

The supply unit 494 includes a cartridge holder 451 which is a filling section for mounting the liquid cartridges 450, a tube 456, a liquid feed unit 452 including a liquid feed pump, and the like. The liquid cartridges 450 are detachably attached to the cartridge holder 451. The liquid is supplied to the head tank 441 by the liquid feed unit 452 via the tube 456 from the liquid cartridges 450.

The liquid discharge apparatus 1000 includes a conveyance unit 495 to convey a sheet 410. The conveyance unit 495 includes a conveyance belt 412 as a conveyance unit and a sub-scanning motor 416 for driving a conveyance belt 412.

The conveyance belt 412 attracts the sheet 410 and conveys the sheet 410 at a position facing the head 10. The conveyance belt 412 is an endless belt and is stretched between a conveyance roller 413 and a tension roller 414. Attraction of the sheet 410 to the conveyance belt 412 may be applied by electrostatic adsorption, air suction, or the like.

The conveyance roller 413 is driven and rotated by the sub-scanning motor 416 via a timing belt 417 and a timing pulley 418, so that the conveyance belt 412 circulates in the sub-scanning direction SSD.

At one side in the main scanning direction MSD of the carriage 403, a maintenance unit 420 to maintain and recover the head 10 in good condition is disposed on a lateral side of the conveyance belt 412.

The maintenance unit 420 includes, for example, a cap 421 to cap a nozzle face 300*a* of the head 10 and a wiper 422 to wipe the nozzle face. The nozzle face 300*a* is a surface of the nozzle substrate 300 on which the nozzles 301 are formed as illustrated in FIGS. 3 to 5.

The main scan moving unit 493, the supply unit 494, the maintenance unit 420, and the conveyance unit 495 are mounted to a housing that includes the left side plate 491A, the right side plate 491B, and a rear side plate 491C.

In the liquid discharge apparatus 1000 thus configured, the sheet 410 is conveyed on and attracted to the conveyance belt 412 and is conveyed in the sub-scanning direction SSD by the cyclic rotation of the conveyance belt 412.

The head 10 is driven in response to image signals while the carriage 403 moves in the main scanning direction MSD, to discharge liquid to the sheet 410 stopped, thus forming an image on the sheet 410.

As described above, the liquid discharge apparatus 1000 includes the head 10 according to the present embodiment, thus allowing stable formation of high quality images.

Figure 30:
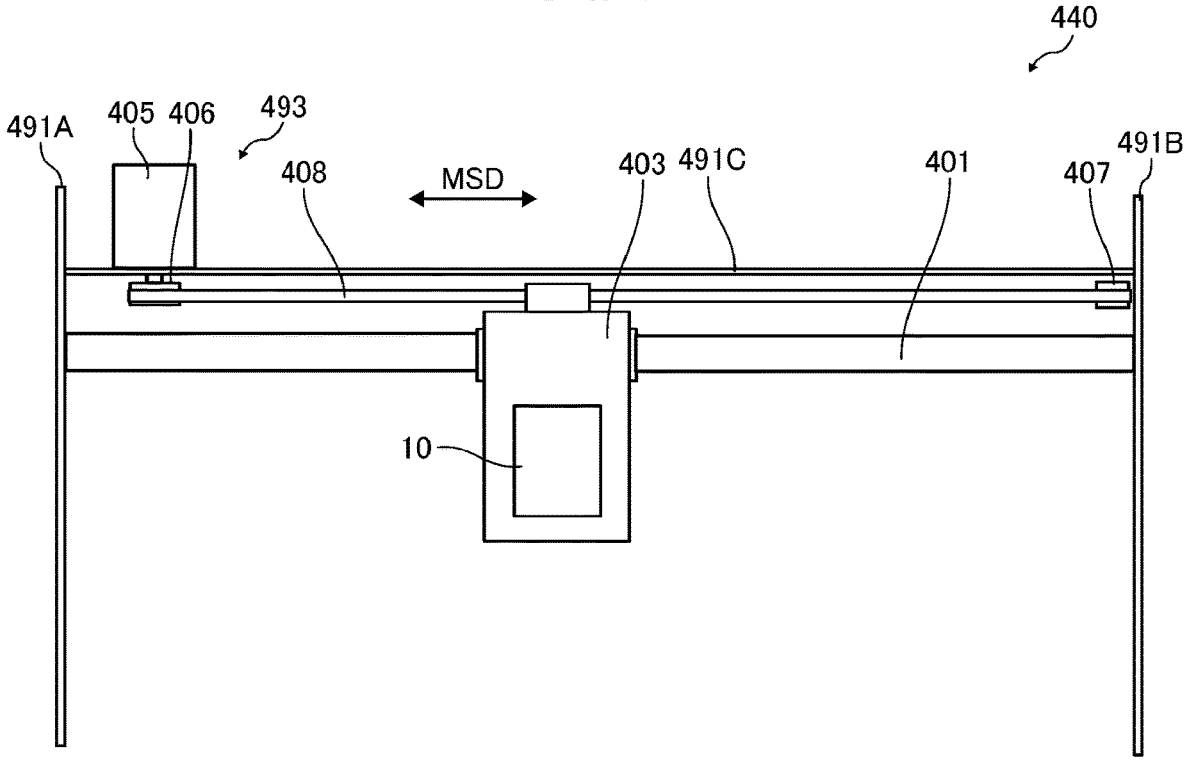
FIG. 30 is an explanatory plan view of a portion of another example of the liquid discharge device.

Next, another example of the liquid discharge device 440 according to the present embodiment is described with reference to FIG. 30. FIG. 30 is a plan view of a portion of another example of the liquid discharge device 440.

The liquid discharge device 440 includes the housing, the main scan moving unit 493, the carriage 403, and the head 10 among components of the liquid discharge apparatus 1000 as illustrated in FIG. 28. The left side plate 491A, the right side plate 491B, and the rear side plate 491C forms the housing.

Note that, in the liquid discharge device 440, at least one of the maintenance unit 420 and the supply unit 494 described above may be mounted on, for example, the right side plate 491B.

Figure 31:
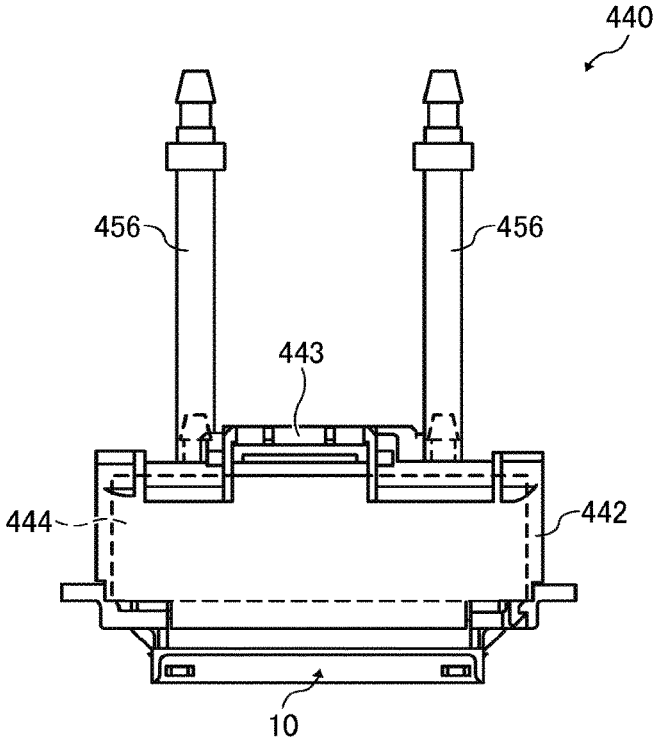
FIG. 31 is an explanatory plan view of still another example of the liquid discharge device.

Next, still another example of the liquid discharge device 440 according to the present embodiment is described with reference to FIG. 31. FIG. 31 is a front view of still another example of the liquid discharge device 440.

The liquid discharge device 440 includes the head 10 to which a channel part 444 is mounted and a tube 456 connected to the channel part 444.

Further, the channel part 444 is disposed inside a cover 442. Instead of the channel part 444, the liquid discharge device 440 may include the head tank 441. A connector 443 electrically connected with the head 10 is provided on an upper part of the channel part 444.

In the above-described embodiments, the "liquid discharge apparatus" includes the head or the liquid discharge device and drives the head to discharge liquid. The liquid discharge apparatus may be, for example, an apparatus capable of discharging liquid to a material to which liquid can adhere and an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form meaningless images, such as meaningless patterns, or fabricate three-dimensional images.

The above-described term "material on which liquid can be adhered" represents any material on which liquid can be at least temporarily adhered, a material on which liquid is adhered and fixed, or a material into which liquid is adhered to permeate. Examples of the "material on which liquid can be adhered" include recording media, such as paper sheet, recording paper, recording sheet of paper, film, and cloth, electronic component, such as electronic substrate and piezoelectric element, and media, such as powder layer, organ model, and testing cell. The "material on which liquid can be adhered" includes any material on which liquid is adhered, unless particularly limited.

Examples of the material on which liquid can be adhered include any materials on which liquid can be adhered even temporarily, such as paper, thread, fiber, fabric, leather, metal, plastic, glass, wood, ceramic, construction materials (e.g., wall paper or floor material), and cloth textile.

Examples of the "liquid" are, e.g., ink, treatment liquid, DNA sample, resist, pattern material, binder, fabrication liquid, or solution and dispersion liquid including amino acid, protein, or calcium.

The "liquid discharge apparatus" may be an apparatus to relatively move a liquid discharge head and a material on which liquid can be adhered. However, the liquid discharge apparatus is not limited to such an apparatus. For example, the liquid discharge apparatus may be a serial head apparatus that moves the liquid discharge head or a line head apparatus that does not move the liquid discharge head.

Examples of the "liquid discharge apparatus" further include a treatment liquid coating apparatus to discharge a treatment liquid to a sheet surface to coat the sheet with the treatment liquid to reform the sheet surface and an injection granulation apparatus to discharge a composition liquid including a raw material dispersed in a solution from a nozzle to mold particles of the raw material.

The "liquid discharge device" is an assembly of parts relating to liquid discharge. The term "liquid discharge device" represents a structure including the liquid discharge head and a functional part(s) or mechanism combined to the liquid discharge head to form a single unit. For example, the "liquid discharge device" includes a combination of the liquid discharge head with at least one of a head tank, a carriage, a supply unit, a maintenance unit, and a main scan moving unit.

Examples of the "single unit" include a combination in which the liquid discharge head and one or more functional parts and devices are secured to each other through, e.g., fastening, bonding, or engaging, and a combination in which one of the liquid discharge head and the functional parts and devices is movably held by another. Further, the liquid discharge head, the functional parts, and the mechanism may be configured to be detachable from each other.

The liquid discharge device may be, for example, formed by the liquid discharge head and the head tank as a single unit, such as the liquid discharge device 440 illustrated in FIG. 31. Alternatively, the liquid discharge head and the head tank coupled (connected) with a tube or the like may form the liquid discharge device as a single unit. A unit including a filter may be added at a position between the head tank and the liquid discharge head of the liquid discharge device.

The liquid discharge head and the carriage may form the "liquid discharge device" as a single unit.

In still another example, the liquid discharge device includes the liquid discharge head movably held by a guide member that forms part of a main scan moving unit, so that the liquid discharge head and the main scan moving unit form a single unit. Like the liquid discharge device 440 illustrated in FIG. 30, the liquid discharge head, the carriage, and the main scan moving unit may form the liquid discharge device as a single unit.

In still another example, the cap that forms part of the maintenance unit is secured to the carriage mounting the liquid discharge head so that the liquid discharge head, the carriage, and the maintenance unit form a single unit as the liquid discharge device.

Like the liquid discharge device 440 illustrated in FIG. 31, the tube is connected to the liquid discharge head mounting the head tank or the channel part so that the liquid discharge head and the supply unit form a single unit as the liquid discharge device.

The main scan moving unit may be a guide only. The supply unit may be a tube(s) only or a loading unit only.

The pressure generator used in the liquid discharge head is not limited to a particular-type of pressure generator. The pressure generator is not limited to the piezoelectric actuator (or a laminated piezoelectric element) described in the above-described embodiments, and may be, for example, a thermal actuator that employs a electrothermal transducer element, such as a thermal resistor, or an electrostatic actuator including a diaphragm and opposed electrodes.

The terms "image formation", "recording", "printing", "image printing", and "fabricating" used herein may be used synonymously with each other.

The above-described embodiment is one example, and the following aspects of the present disclosure can provide the following advantages, for example.

[First Aspect]

In a first aspect, a bonded substrate includes a first substrate such as the first substrate 100', a second substrate such as the second substrate 200' bonded to the first substrate with adhesive such as adhesive 114 applied to the second substrate, and a checking structure such as the checking structure 115 disposed on the first substrate and facing the second substrate. The checking structure includes a bonding surface portion such as the bonding surface portion 115*e* to be adhered to the second substrate with the adhesive, and an insufficiency detection surface such as the third surface portion 115*c* to detect insufficient adhesion, a height of the insufficiency detection surface is lower than a height of the bonding surface portion.

The adhesive does not contact the insufficiency detection surface when an adhesion state of the bonding surface portion to the second substrate with the adhesive is insufficient, and the adhesive contacts the insufficiency detection surface when the adhesion state of the bonding surface portion to the second substrate with the adhesive is sufficient.

According to the first aspect, the first substrate includes a checking structure including a surface portion to check insufficient adhesion. The height of the surface portion of the first substrate is set so that the adhesive applied to the second substrate does not contact the first substrate when an adhesion state of the adhesive adhered on the surface portion of the first substrate is insufficient, and adhesive applied to the second substrate contacts the first substrate when the adhesion state of the adhesive adhered on the surface portion of the first substrate is sufficient.

Thus, it is possible to ascertain that the adhesion state of the adhesive is insufficient through checking the adhesive applied to the second substrate not contacting the insufficiency detection surface of the first substrate, for example. Therefore, according to the first aspect, it is possible to confirm whether the adhesion state between the first substrate and the second substrate is insufficient after bonding the first substrate and the second substrate.

[Second Aspect]

In a second aspect of the bonded substrate in the first aspect, the checking structure further includes an excess detection surface such as the second surface portion 115*b* to detect excessive adhesion, a height of the excess detection surface is lower than the height of the insufficiency detection surface such as the third surface portion 115*c*. The adhesive such as adhesive 114 contacts the excess detection surface when an adhesion state of the bonding surface portion such as the bonding surface portion 115*e* to the second substrate such as the second substrate 200' with the adhesive is excessive, and the adhesive does not contact the excess detection surface when the adhesion state of the bonding surface portion to the second substrate with the adhesive is not excessive.

According to the second aspect, a checking structure to check the adhesion state is provided on the first substrate. The checking structure includes an excess detection surface to check excessive adhesion. A height of the excess detection surface is set so that the adhesive applied to the second substrate contacts the excess detection surface when the adhesion state of the bonding surface portion of the first substrate to the second substrate with the adhesive is excessive, and the adhesive applied to the second substrate does not contact the excess detection surface of the first substrate when the adhesion state of the adhering surface of the first substrate to the second substrate is not excessive.

Thus, it is possible to ascertain that the adhesion state of the first substrate to the second substrate with the adhesive is excessive through checking whether the adhesive applied to the second substrate contacts the excess detection surface. Therefore, according to the second aspect, it is possible to confirm whether the adhering state between the first substrate and the second substrate is excessive after bonding the first substrate and the second substrate.

[Third Aspect]

In a third aspect of the bonded substrate in the second aspect, a checking structure such as the checking structure 115 includes another surface portion such as the fourth surface portion 115*d*, a height of which is lower than the insufficiency detection surface such as the third surface portion 115*c* and higher than the excess detection surface such as the second surface portion 115*b*.

According to the third aspect, it is possible to ascertain the adhesion state more precisely.

[Fourth Aspect]

In a fourth aspect of a bonded substrate includes a first substrate such as the first substrate 100', a second substrate such as the second substrate 200' bonded to the first substrate with adhesive such as the adhesive 114 applied to the second substrate, and a checking structure such as the checking structure 115 disposed on the first substrate and facing the second substrate. The checking structure includes a bonding surface portion such as the bonding surface portion 115*e* to be adhered to the second substrate, and an excess detection surface such as the second surface portion 115*b* to detect excessive adhesion.

A height of the excess detection surface is lower than a height of the bonding surface portion. The adhesive contacts the excess detection surface when an adhesion state of the bonding surface portion to the second substrate with the adhesive is excessive, and the adhesive does not contact the excess detection surface when the adhesion state of the bonding surface portion to the second substrate with the adhesive is not excessive.

According to the second aspect, a checking structure to check the adhesion state is provided on the first substrate. The checking structure includes an excess detection surface to check excessive adhesion.

A height of the excess detection surface is set so that the adhesive applied to the second substrate contacts the excess detection surface when the adhesion state of the bonding surface portion of the first substrate to the second substrate with the adhesive is excessive, and the adhesive applied to the second substrate does not contact the excess detection surface of the first substrate when the adhesion state of the adhering surface of the first substrate to the second substrate is not excessive.

Thus, it is possible to ascertain that the adhesion state of the first substrate to the second substrate with the adhesive is excessive through checking whether the adhesive applied to the second substrate contacts the excess detection surface. Therefore, according to the second aspect, it is possible to confirm whether the adhering state between the first substrate and the second substrate is excessive after bonding the first substrate and the second substrate.

[Fifth Aspect]

In a fifth aspect of the bonded substrate in any one of the first aspect to fourth aspect, the second substrate such as the second substrate 200' includes a first facing surface portion such as the wide portions 204*c* to face the insufficiency detection surface such as the third surface portion 115*c* of the checking structure such as the checking structure 115 of the first substrates such as the first substrate 100', and a second facing surface portion such as the wide portion 204*b* to face the excess detection surface such as the second surface portion 115*b* of the checking structure of the first substrate.

A height of the first facing surface portion is identical to a height of the second facing surface portion.

According to the fifth aspect, it is possible to ascertain the adhesion state more easily.

[Sixth Aspect]

In a sixth aspect of the bonded substrate in any one of the first aspect to the fifth aspect, the second substrate has a light transmissive property.

According to the sixth aspect, it is possible to confirm which of the surface portion of the checking structure contacts the adhesive such as adhesive 114 through the second substrate by an optical measuring device.

[Seventh Aspect]

In a seventh aspect of a bonded substrate in the sixth aspect, the second substrate such as the second substrate 200' transmits infrared light.

According to the seventh aspect, it is possible to confirm which of the surface portions of the checking structure such as the checking structure 115 contact the adhesive such as the adhesive 114 through the second substrate by the optical measuring device using the infrared ray such as an infrared microscope (IR microscope).

[Eighth Aspect]

In an eighth aspect of a bonded substrate in any one of the first aspect to the seventh aspect, the first substrate such as the first substrate 100' includes a plurality of layers on a substrate. The insufficiency detection surface such as the third surface portion 115*c* includes a part of the plurality of layers. The excess detection surface such as the second surface portion 115*b* of the checking structure includes a part or none of the plurality of layers. The bonding surface portion such as the bonding surface portion 115*e* includes all of the plurality of layers.

According to the eighth aspect, the checking structure such as the checking structure 115 can be formed together with a multilayer structure formed on a substrate surface. Thus, the checking structure can be formed without increasing number of manufacturing processes.

[Ninth Aspect]

In a ninth aspect of a bonded substrate in any one of the first aspect to eighth aspect, the second substrate such as the second substrate 200' includes a concave portion such as the concave portion 204*f* in at least a part of a periphery of the first facing portion such as the wide portions 204*c* and the second facing portion such as the wide portion 204*b*. A height of the concave portion is lower than each of the height of the first facing surface portion and the height of the second facing surface portion.

According to this, when the first substrate and the second substrate are bonded to each other, excess adhesive applied to the second substrate can enter into the recessed portion, and the excessive adhesive is bonded to the first substrate.

Thus, it is possible to prevent the adhesive from coming toward the surface portion which should originally not come into contact with the surface portion among the plurality of surface portions in the state confirmation structure. Further, it is possible to accurately determine the propriety of the adhesion state.

[Tenth Aspect]

In a tenth aspect of a bonded substrate in the ninth aspect, the second substrate such as the second substrate 200' includes a connection portion such as the narrowed portion 204*g* to connect the first facing surface such as the wide portion 204*c* and the second facing surface such as the wide portion 204*b*. A height of the connection portion is same as each of the height of the first facing surface portion and the height of the second facing surface portion, and a width of the connection portion is narrower than each of a width of the first facing surface and a width of the second facing surface.

According to the tenth aspect, unevenness of thickness of the adhesive applied to the second substrate in a predetermined direction can be ascertained by measuring unevenness of an upper surface of the adhesive in the predetermined direction. The measurement can be performed using a general step gauge or the like.

[Eleventh Aspect]

In an eleventh aspect of a liquid discharge head, the liquid discharge head includes a nozzle substrate such as the nozzle substrate 300 including nozzles such as the nozzles 301 to discharge a liquid, and the bonded substrate in any one of the first aspect to the tenth aspect. The bonded substrate including a plurality of piezoelectric elements such as the piezoelectric elements 101 to be deformed to discharge the liquid from the nozzles, respectively.

According to the eleventh aspect, it is possible to fabricate a highly reliable liquid discharge head in which substrates are properly adhered to each other.

[Twelfth Aspect]

In a twelfth aspect of a liquid discharge apparatus, the liquid discharge apparatus includes the liquid discharge head in the eleventh aspect.

According to the twelfth aspect, it is possible to fabricate a highly reliable liquid discharge device in which the substrates are adhered properly.

[Thirteenth Aspect]

In a thirteenth aspect of a liquid discharge device in the twelfth aspect, the liquid discharge head and at least one of a head tank that stores liquid to be supplied to the liquid discharge head, a carriage on which the liquid discharge head is mounted, a supply mechanism that supplies liquid to the liquid discharge head, a maintenance mechanism that performs maintenance of the liquid discharge head, and a main scan moving mechanism to move the liquid discharge head in a main scanning direction form the liquid discharge device as a single unit.

According to the twelfth aspect, it is possible to fabricate a highly reliable liquid discharge device in which the substrates are adhered properly.

[Fourteenth Aspect]

In a fourteenth aspect of a liquid discharge apparatus includes the liquid discharge head in the eleventh aspect or the liquid discharge device in the twelfth aspect or the thirteenth aspect.

According to the fourteenth aspect, it is possible to implement a liquid discharge apparatus including the above-described bonded substrates in which substrates are adhered properly. Thus, the liquid discharge apparatus can highly reliably discharge the liquid.

[Fifteenth Aspect]

In a fifteenth aspect of a manufacturing method of a bonded substrate obtained by bonding a first substrate such as the first substrate 100' and a second substrate such as the second substrate 200' with an adhesive such as the adhesive 114 applied to the second substrate. A checking structure such as the checking structure 115 is formed.

The checking structure includes an insufficiency detection surface such as the third surface portion 115*c* disposed to face the second substrate on the first substrate. A height of the insufficiency detection surface is lower than a height of a bonding surface portion such as the bonding surface portion 115*e* of the first substrate bonded to the second substrate with the adhesive applied to the second substrate.

Further, the height of the insufficiency detection surface is set such that the adhesive applied to the second substrate does not contact the insufficiency detection surface when the adhesion state of the adhesive on the bonding surface portion is insufficient. The insufficiency detection surface such as the third surface portion 115*c* has a height at which the adhesive applied to the second substrate contacts the insufficiency detection surface when the adhesive applied on the second substrate is sufficient.

The adhesive is applied to the second substrate, and the first substrate and the second substrate are bonded with each other with the adhesive applied on the second substrate. Then, the adhesion state of the adhesive on the insufficiency detection surface is checked. The bonded substrate in which the adhesive contacts the insufficiency detection surface is selected among the bonded substrates formed by bonding the first substrate and the second substrate with adhesive.

According to the fifteenth aspect, it is possible to manufacture a highly reliable bonded substrate in which the substrates are appropriately adhered to each other.

[Sixteenth Aspect]

In a sixteenth aspect of a manufacturing method of a bonded substrate obtained by bonding a first substrate such as the first substrate 100' and a second substrate such as the second substrate 200' with an adhesive such as the adhesive 114 applied to the second substrate. A checking structure such as the checking structure 115 is formed. The checking structure includes an excess detection surface such as the second surface portion 115*b*. The second surface portion 115*b* disposed to face the second substrate on the first substrate.

A height of the excess detection surface is lower than a height of a bonding surface portion such as the bonding surface portion 115*e* of the first substrate bonded to the second substrate with the adhesive applied to the second substrate. Further, the height of the excess detection surface is set such that the adhesive applied to the second substrate contacts the excess detection surface when the adhesion state of the adhesive on the bonding surface portion is excessive.

The excess detection surface such as the second surface portion 115*b* has a height at which the adhesive applied to the second substrate does not contact the excess detection surface when the adhesive applied on the second substrate is not excessive. The adhesive is applied to the second substrate, and the first substrate and the second substrate are bonded with each other with the adhesive applied on the second substrate.

Then, the adhesion state of the adhesive on the excess detection surface is checked. The bonded substrate in which the adhesive does not contact the excess detection surface is selected among the bonded substrates formed by bonding the first substrate and the second substrate with adhesive.

According to the fifteenth aspect, it is possible to manufacture a highly reliable bonded substrate in which the substrates are appropriately adhered to each other.

[Seventeenth Aspect]

In a seventeenth aspect of a bonded substrate, a substrate such as the first substrate 100' to be bonded to another substrate such as the second substrate 200' with an adhesive such as the adhesive 114. The substrate includes a plurality of surface portions such as the first surface portion 115*a*, the second surface portion 115*b*, the third surface portion 115*c*, and the fourth surface portion 115*d* each having different heights in a region enclosed by a bonding surface portion such as the bonding surface portion 115*e* to be adhered to another substrate. The plurality of surface portions includes at least two surface portions 115*a* to 115*d*, the height of which are lower than the bonding surface portion, having different heights from each other.

According to the seventeenth aspect, it is possible to manufacture a highly reliable bonded substrate in which the substrates are appropriately adhered to each other.

[Eighteenth Aspect]

In an eighteenth aspect of a bonded substrate, the bonded substrate in the seventeenth aspect and the other substrates described-above are bonded with an adhesive.

According to the eighteenth aspect, it is possible to provide a highly reliable bonded substrate adhered properly.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A bonded substrate comprising:

a first substrate;

a second substrate bonded to the first substrate with adhesive applied to the second substrate; and a checking structure disposed on the first substrate and facing the second substrate, the checking structure including:

a bonding surface portion to be adhered to the second substrate with the adhesive; and an insufficiency detection surface to detect insufficient adhesion, a height of the insufficiency detection surface being lower than a height of the bonding surface portion, wherein the adhesive does not contact the insufficiency detection surface when an adhesion state of the bonding surface portion to the second substrate with the adhesive is insufficient, and the adhesive contacts the insufficiency detection surface when the adhesion state of the bonding surface portion to the second substrate with the adhesive is sufficient.

2. The bonded substrate according to claim 1, wherein the checking structure further comprises an excess detection surface to detect excessive adhesion, a height of the excess detection surface is lower than the height of the insufficiency detection surface, the adhesive contacts the excess detection surface when an adhesion state of the bonding surface portion to the second substrate with the adhesive is excessive, and the adhesive does not contact the excess detection surface when the adhesion state of the bonding surface portion to the second substrate with the adhesive is not excessive.

3. The bonded substrate according to claim 2, wherein the checking structure comprises another surface portion, a height of which is lower than the insufficiency detection surface and higher than the excess detection surface.

4. The bonded substrate according to claim 2, wherein the bonding surface portion encloses the insufficiency detection surface and the excess detection surface inside the bonding surface portion.

5. The bonded substrate according to claim 2, wherein the first substrate includes a plurality of layers on a substrate, the insufficiency detection surface includes a part of the plurality of layers, the excess detection surface of the checking structure includes a part of the plurality of layers, a number of layers of which is smaller than a number of layers of the insufficiency detection surface, and the bonding surface portion includes the plurality of layers, a number of layers of which is larger than the number of layers of the insufficiency detection surface.

6. The bonded substrate according to claim 5, wherein the first substrate includes a piezoelectric element including a part of the plurality of layers, the part of the plurality of layers of the insufficiency detection surface includes the part of the plurality of layers of the piezoelectric element.

7. The bonded substrate according to claim 2, wherein the second substrate includes:

a first facing surface portion to face the insufficiency detection surface of the checking structure of the first substrate; and a second facing surface portion to face the excess detection surface of the checking structure of the first substrate, a height of the first facing surface portion is identical to a height of the second facing surface portion.

8. The bonded substrate according to claim 7, wherein the second substrate includes a concave portion in at least a part of a periphery of the first facing surface portion and the second facing surface portion, a height of the concave portion is lower than each of the height of the first facing surface portion and the height of the second facing surface portion.

9. The bonded substrate according to claim 8, wherein the second substrate includes a connection portion to connect the first facing surface portion and the second facing surface portion, a height of the connection portion is same as each of the height of the first facing surface portion and the height of the second facing surface portion, and a width of the connection portion is narrower than each of a width of the first facing surface portion and a width of the second facing surface portion.

10. The bonded substrate according to claim 1, wherein the second substrate has a light-transmissive property.

11. The bonded substrate according to claim 10, wherein the second substrate transmits infrared light.

12. A liquid discharge head comprising:

a nozzle substrate including nozzles to discharge a liquid; and the bonded substrate according to claim 1, wherein the bonded substrate includes a plurality of piezoelectric elements to be deformed to discharge the liquid from the nozzles, respectively.

13. A liquid discharge apparatus comprising the liquid discharge head according to claim 12.

14. A bonded substrate comprising:

a first substrate;

a second substrate bonded to the first substrate with adhesive applied to the second substrate; and a checking structure disposed on the first substrate and facing the second substrate, the checking structure including:

a bonding surface portion to be adhered to the second substrate; and an excess detection surface to detect excessive adhesion, a height of the excess detection surface being lower than a height of the bonding surface portion, wherein the adhesive contacts the excess detection surface when an adhesion state of the bonding surface portion to the second substrate with the adhesive is excessive, and the adhesive does not contact the excess detection surface when the adhesion state of the bonding surface portion to the second substrate with the adhesive is not excessive.

15. A liquid discharge head comprising:

a nozzle substrate including nozzles to discharge a liquid; and the bonded substrate according to claim 14, wherein the bonded substrate includes a plurality of piezoelectric elements to be deformed to discharge the liquid from the nozzles, respectively.

16. A liquid discharge apparatus comprising the liquid discharge head according to claim 15.

* * * * *